US011261407B2

(12) United States Patent
Schmiedel et al.

(10) Patent No.: US 11,261,407 B2
(45) **Date of Patent: *Mar. 1, 2022**

(54) VISCOELASTIC, SOLID-STATE SURFACTANT COMPOSITION HAVING A HIGH SURFACTANT CONTENT

(71) Applicant: Henkel AG & Co. KGaA, Duesseldorf (DE)

(72) Inventors: Peter Schmiedel, Duesseldorf (DE); Filiz Yapici, Duesseldorf (DE); Boray Torun, Duesseldorf (DE); Anna Klemmer, Duesseldorf (DE); Michael Dreja, Neuss (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/715,691

(22) Filed: Dec. 16, 2019

(65) Prior Publication Data

US 2020/0115657 A1 Apr. 16, 2020

Related U.S. Application Data

(63) Continuation of application No. PCT/EP2018/065466, filed on Jun. 12, 2018.

(30) Foreign Application Priority Data

| | | |
|---|---|---|
| Jun. 16, 2017 | (DE) | 102017210141.5 |
| Jun. 16, 2017 | (DE) | 102017210143.1 |
| Dec. 20, 2017 | (DE) | 102017223456.3 |

(51) Int. Cl.

| | |
|---|---|
| ***C11D 1/02*** | (2006.01) |
| ***C11D 1/12*** | (2006.01) |
| ***C11D 1/22*** | (2006.01) |
| ***C11D 1/72*** | (2006.01) |
| ***C11D 1/83*** | (2006.01) |
| ***C11D 3/43*** | (2006.01) |
| ***B08B 3/04*** | (2006.01) |
| ***C11D 3/22*** | (2006.01) |
| ***C11D 1/37*** | (2006.01) |
| ***C11D 11/00*** | (2006.01) |
| ***C11D 17/00*** | (2006.01) |
| *C11D 1/26* | (2006.01) |
| *C11D 1/29* | (2006.01) |

(52) U.S. Cl.

CPC ..... *C11D 3/221* (2013.01); *C11D 1/37* (2013.01); *C11D 1/83* (2013.01); *C11D 11/0017* (2013.01); *C11D 17/006* (2013.01); *C11D 1/22* (2013.01); *C11D 1/26* (2013.01); *C11D 1/29* (2013.01); *C11D 1/72* (2013.01)

(58) Field of Classification Search

CPC .... C11D 1/02; C11D 1/12; C11D 1/22; C11D 1/72; C11D 1/83; C11D 3/2068; C11D 3/2096; C11D 3/221; C11D 3/43; C11D 11/0017; B08B 3/04

See application file for complete search history.

(56) References Cited

U.S. PATENT DOCUMENTS

| | | | | |
|---|---|---|---|---|
| 2003/0125222 | A1 | 7/2003 | Jahns et al. | |
| 2010/0240569 | A1 | 9/2010 | Boutique et al. | |
| 2010/0240571 | A1* | 9/2010 | Boutique | C11D 17/0026 510/338 |
| 2020/0115653 | A1* | 4/2020 | Yapici | C11D 17/003 |
| 2020/0115655 | A1* | 4/2020 | Schmiedel | C11D 1/28 |
| 2020/0115656 | A1* | 4/2020 | Schmiedel | C11D 1/721 |

FOREIGN PATENT DOCUMENTS

| | | | |
|---|---|---|---|
| DE | 2857292 | A1 | 2/1980 |
| DE | 3324258 | A1 | 1/1984 |
| DE | 102008051799 | A1 | 4/2010 |
| EP | 0066944 | A1 | 12/1982 |
| EP | 0185427 | A2 | 6/1986 |
| EP | 0241984 | A2 | 10/1987 |
| EP | 0241985 | A2 | 10/1987 |
| EP | 0253567 | A1 | 1/1988 |
| EP | 0272033 | A2 | 6/1988 |
| EP | 0274907 | A1 | 7/1988 |
| EP | 0357280 | A2 | 3/1990 |
| EP | 0442101 | A1 | 8/1991 |
| EP | 1156101 | A1 | 11/2001 |
| EP | 2885220 | B1 | 6/2015 |
| EP | 2885221 | B1 | 6/2015 |
| JP | S6183300 | A | 4/1986 |
| JP | H0987698 | A | 3/1997 |
| WO | 0149817 | A2 | 7/2001 |
| WO | 02086074 | A2 | 10/2002 |
| WO | 2010108002 | A1 | 9/2010 |

OTHER PUBLICATIONS

Macosko, Christopher W. "Rheology Principles, Measurements and Applications", Linear Viscoelasticity. VCH, 1994, pp. 121-126.

Schramm, Gebhard. "Einfuehrung in Rheologie und Rheometrie". HAAKE Rheometer. Gebrueder HAAKE GmbH, 1995, pp. 156-173, Germany.

International Search Report PCT/EP2018/065466 Completion Date: Sep. 7, 2018 dated Sep. 24, 2018 6 pages.

* cited by examiner

*Primary Examiner* — Brian P Mruk

(74) *Attorney, Agent, or Firm* — Thomas G. Krivulka

(57) ABSTRACT

A viscoelastic, solid-state surfactant composition for textile treatment, containing based on the total weight thereof (i) a total amount of 10% to 70% by weight of at least one surfactant, (ii) a total amount of more than 1% by weight of at least one benzylidene alditol compound of formula (I), and (iii) water, constitutes an easily soluble, aesthetically pleasing and storage-stable form of a solid-state composition for providing surfactant-containing liquors.

14 Claims, No Drawings

VISCOELASTIC, SOLID-STATE SURFACTANT COMPOSITION HAVING A HIGH SURFACTANT CONTENT

FIELD OF THE INVENTION

The present invention relates to the technical field of solid surfactant compositions for providing surfactant-containing liquors for treating textiles, in particular for cleaning textiles.

BACKGROUND OF THE INVENTION

Textile treatment agents are usually present in solid form (as powder or tablets, for example) or in liquid form (or also as a flowing gel). Liquid detergents or cleaning agents in particular are increasingly popular with consumers.

Solid textile treatment agents have the advantage that, unlike liquid textile treatment agents, they do not require any preservatives, and the contained ingredients (e.g. bleaching agents or enzymes) can be incorporated in a more stable manner. Liquid product formats are increasingly gaining acceptance in the market, particularly due to their quick solubility and the resulting quick availability of the active ingredients they contain.

Consumers have grown accustomed to the convenient metering of pre-portioned textile treatment agents, such as washing agent pouches, and use these products in the form of tablets (solid textile treatment agents) or in the form of pouches (also: pillow-like packaging) that are usually filled with at least one liquid textile treatment agent. In addition to the above-mentioned advantages, however, the use of liquids has for example the disadvantage that the liquid textile treatment agent flows out of the pouch of the portion when there are leaks therein.

Single-use portions in water-soluble pouches are also popular with consumers because of the attractive appearance of the pouches. The appearance of the dosage form is becoming increasingly important. Besides good cleaning performance and adequate storage stability, a good appearance is one of the reasons on which the selection of a product is based. In particular transparent products are perceived by the consumer as optically appealing. Solid surfactant compositions used for textile cleaning are usually opaque. The object is therefore also that of providing translucent to transparent solid surfactant compositions.

From the perspective of consumers, it would be also desirable to combine the advantages of the solid and liquid product formats and provide a dosage form that is improved compared with the prior art, particularly for detergents or cleaning agents that are usually liquids. For this purpose, it has to be possible for the contained components to be portioned for single-use and for a visual appearance that is attractive to consumers, in particular transparency or translucency, to be achieved simultaneously.

BRIEF SUMMARY OF THE INVENTION

In particular when using solid shaped bodies that have to be dissolved or dispersed in an aqueous medium for use on a substrate, it is particularly important that the solid dissolves well in water. When dosing single-use portions, together with the laundry, into the drum of the washing machine, it must be possible to incorporate the single-use portion into the aqueous, liquid liquor quickly, so that the laundry (e.g. textile) coming into contact with the shaped body in the drum is not damaged by prolonged excess concentration of the ingredients of the surfactant composition. It is therefore the object of the invention to provide solid surfactant compositions, in particular as single-use portions in the form of pieces of a shaped body, which can be dissolved or dispersed in water upon contact therewith.

WO 02/086074 A1 discloses viscoelastic, solid surfactant compositions having a storage modulus of from 40,000 to 800,000 Pa. The viscoelastic surfactant compositions disclosed therein are liquid-crystalline surfactant phases. The preparation of the viscoelastic surfactant compositions from the prior art is dependent on phase behavior of the surfactants contained therein in each case, and this puts limits on the degree of freedom in terms of the formulation when selecting the surfactants and the amounts of use thereof.

A further object is therefore that of providing solid surfactant compositions that behave viscoelastically irrespectively of the phase behavior of the surfactants used.

Surprisingly, it has been found that this object can be achieved by the formulation of a composition containing at least one surfactant and at least one benzylidene alditol compound in specific amounts.

In a first embodiment, the invention therefore relates to a viscoelastic, solid surfactant composition for treating textiles, containing, based on the total weight thereof, (i) a total amount of from 10 to 70 wt. % of at least one surfactant and (ii) a total amount of more than 1 wt. % of at least one benzylidene alditol compound of formula (I)

(I)

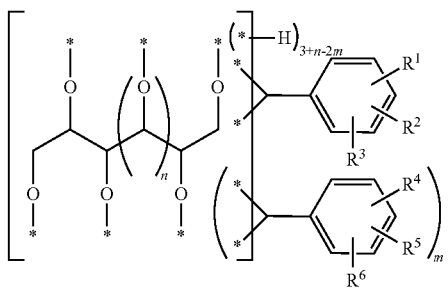

in which

*- represents a covalent single bond between an oxygen atom of the alditol backbone and the provided functional group, n represents 0 or 1, preferably 1, m represents 0 or 1, preferably 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxy group, a —C(=O)—NH—$NH_2$ group, a —NH—C(=O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxy group, a —C(=O)—NH—$NH_2$ group, a —NH—C(=O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, and (iii) water.

As a second embodiment of the first subject of the invention, a viscoelastic, solid surfactant composition for treating textiles is particularly preferred which contains, based on the total weight thereof, (i) a total amount of from 10 to 70 wt. % of at least one surfactant and (ii) a total amount of more than 1 wt. % of at least one benzylidene alditol compound of formula (I)

(I)

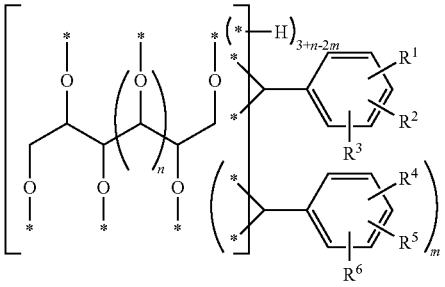

in which

*- represents a covalent single bond between an oxygen atom of the alditol backbone and the provided functional group, n represents 0 or 1, preferably 1, m represents 0 or 1, preferably 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxy group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxy group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, and (iii) water, with the proviso that the composition has a storage modulus of between $10^3$ Pa and $10^8$ Pa, preferably between $10^4$ Pa and $10^8$ Pa and a loss modulus (in each case at 20° C., with a deformation of 0.1% and a frequency of 1 Hz), and the storage modulus in the frequency range between $10^{-2}$ Hz and 10 Hz is at least twice as great as the loss modulus. More preferably, the composition has a storage modulus in a range of from $10^5$ Pa to $10^7$ Pa.

So as to further optimize the stability properties of the above-mentioned composition, it is preferable for the storage modulus to be at least five times greater than the loss modulus, particularly preferably at least ten times greater than the loss modulus (in each case at 20° C., with a deformation of 0.1% and a frequency of 1 Hz).

DETAILED DESCRIPTION OF THE INVENTION

All definitions and preferred embodiments mentioned below apply equally to the first embodiment and the second embodiment, unless defined otherwise.

The viscoelastic, solid surfactant composition combines all the advantages of a liquid composition, and is an aesthetic product form that has a good dissolution profile and an excellent performance profile on the substrate within the context of textile treatment. WO 2010/108002 discloses structured liquid surfactant compositions that contain at most 1 wt. % of a benzylidene alditol compound as a structuring agent. Viscoelastic, solid surfactant compositions containing benzylidene alditol compounds are not described in said document.

The viscoelastic, solid surfactant composition of the present invention is stable in storage and dimensionally stable. Said viscoelastic, solid surfactant composition undergoes almost no syneresis, even after long periods of storage.

A substance (e.g. a composition) is solid according to the definition of the invention if it is in the solid physical state at 20° C. and 1013 mbar.

As is known, and therefore as per the invention, a substance (e.g. a composition) is viscoelastic and solid when the storage modulus of the substance is greater than the provided loss modulus at 20° C. When mechanical forces are applied to the substance, it has the properties of an elastic solid, and also exhibits a viscosity similar to that of a liquid. The termini of the storage modulus and loss modulus, and the determination of the values of these moduli, are well known to a person skilled in the art (cf. Christopher W. Macosco, "Rheology Principles, Measurements and Applications", VCH, 1994, page 121 et seq. or Gebhard Schramm, "Einführung in die Rheologie und Rheometrie," Karlsruhe, 1995, page 156 et seq. or WO 02/086074 A1, page 2, third paragraph to page 4, end of the first paragraph).

Within the context of this invention, the rheological characterization is carried out using a rotational rheometer, for example TA-Instruments, type AR G2, Malvern "Kinexus," using a cone-plate measuring system of a 40 mm diameter and 2° opening angle at a temperature of 20° C. This is a controlled shear stress rheometer. However, the determination can also be carried out using other instruments or measurement geometries of comparable specifications. In this case, it is advantageous to solidify the viscoelastic solid composition in the measuring instrument. For this purpose, the sample is prepared in a liquid state outside the measuring device, then poured into the measuring chamber and solidified therein and measured.

The measurement of the storage modulus (abbreviation: G') and of the loss modulus (abbreviation: G") (in each case unit: Pa) was carried out using the equipment described above in an experiment involving oscillating deformation. For this purpose, the linear viscoelastic region is first determined in a stress sweep experiment. In this case, the shear stress amplitude is increased at a constant frequency of, for example, 1 Hz. The moduli G' and G" are plotted in a log-log plot. Either the shear stress amplitude or the (resulting) deformation amplitude can be plotted on the x-axis. The storage modulus G' is constant below a certain shear stress amplitude or deformation amplitude, above which it collapses. The break point is expediently determined by applying tangents to the two parts of the curve. The corresponding deformation amplitude or shear stress amplitude is usually referred to as "critical deformation" or "critical shear stress".

In order to determine the frequency dependence of the moduli, a frequency ramp, e.g. between 0.01 Hz and 10 Hz, is performed at a constant deformation amplitude. The deformation amplitude has to be selected such that it is within the linear range, i.e. below the above-mentioned critical deformation. In the case of compositions according to the invention, a deformation amplitude of 0.1% has been found to be suitable. The moduli G' and G" are plotted against the frequency in a log-log plot.

A substance (e.g. a composition) is liquid according to the definition of the invention if it is in the liquid physical state at 20° C. and 1013 mbar.

A chemical compound is an organic compound if the molecule of the chemical compound contains at least one covalent bond between carbon and hydrogen. This definition applies, mutatis mutandis, to, inter alia, "organic bleach activators" as the chemical compound.

By implication from the definition of an organic compound, a chemical compound is an inorganic compound if the molecule of the chemical compound does not contain a covalent bond between carbon and hydrogen.

The average molar masses specified for polymeric ingredients within the context of this application are always, unless explicitly stated otherwise, weight-average molar masses $M_w$, which can in principle be determined by means of gel permeation chromatography using an RI detector, it being expedient for the measurement to be carried out as per an external standard.

Within the meaning of the invention, a surfactant-containing liquor is a liquid preparation for treating a substrate that can be obtained by using a surfactant-containing agent which has been diluted with at least one solvent (preferably water). Fabrics or textiles (such as clothing) are considered as the substrate. The portions according to the invention are preferably used to provide a surfactant-containing liquor for mechanical cleaning processes, as are carried out, for example, by a washing machine for textiles.

"At least one," as used herein, refers to 1, 2, 3, 4, 5, 6, 7, 8, 9 or more. In connection with components of the compositions described herein, this information does not refer to the absolute amount of molecules, but to the type of the component. "At least one inorganic base" therefore signifies, for example, one or more different inorganic bases, i.e. one or more different types of inorganic bases. Together with stated amounts, the amounts stated refer to the total amount of the correspondingly designated type of component.

If, within the context of the application, numerical ranges are defined from one number to another number, then the limit values are included in the range.

If, within the context of the application, numerical ranges are defined between one number and another number, then the limit values are not included in the range.

The compounds of the invention preferably have a yield point. The yield point refers to the lowest stress (force per surface area) above which a plastic substance behaves rheologically, like a liquid. It is given in pascals (Pa).

The yield point of the compositions was measured using an AR G2-type rotational rheometer from TA-Instruments. This is what is known as a controlled shear stress rheometer. In order to measure a yield point using a controlled shear stress rheometer, various methods are described in the literature that are known to a person skilled in the art.

In order to determine the yield points within the context of the present invention, the following was carried out at 20° C.:

Shear stress 6 increasing at intervals over time was applied to the samples in the rheometer in a stepped-flow procedure. For example, the shear stress can be increased from the smallest possible value (e.g. 2 mPa) to e.g. 10 Pa over the course of 10 minutes with 10 points per shear stress decade. In the process, the time interval is selected such that the measurement is carried out "quasistatically", i.e. such that the deformation of the sample for each specified shear stress value can come into equilibrium. The equilibrium deformation $\gamma$ of the sample is measured as a function of this shear stress. The deformation is plotted against the shear stress in a double-logarithmic plot. Provided that the sample tested has a yield point, a distinction can clearly be made between two regions in this plot. Below a certain shear stress, purely elastic deformation occurs in accordance with Hooke's law. The gradient of the curve $\gamma$ (6) (log-log plot) in this region is one. Above this shear stress, the yield region begins and the gradient of the curve rises steeply. The shear stress at which the curve deviates sharply, i.e. the transition from elastic to plastic deformation, marks the yield point. It is possible to easily determine the deviation point by applying tangents to the two parts of the curve. Samples without a yield point do not have a characteristic deviation in the $\gamma(\sigma)$ function.

The solid, viscoelastic composition according to the invention preferably has a yield point in the range of from 2.5 to 100 Pa, more preferably from 3 to 80 Pa (measured using a rotational rheometer, cone-plate measuring system of a 40 mm diameter and 2° opening angle at a temperature of 20° C.).

The viscoelastic, solid surfactant composition according to the invention is preferably transparent or translucent. If a mixture according to the invention has a residual light output (transmission) of at least 20% in the spectral range between 380 nm and 780 nm, said mixture is considered to be transparent within the meaning of the invention.

The transparency of the surfactant composition according to the invention can be determined using various methods. The Nephelometric Turbidity Unit (NTU) is frequently used as an indication of transparency. It is a unit, used e.g. in water treatment, for measuring turbidity e.g. in liquids. It is a unit of turbidity measured using a calibrated nephelometer. High NTU values are measured for clouded surfactant compositions, whereas low values are determined for clear, transparent surfactant compositions.

The HACH Turbidimeter 2100Q from Hach Company, Loveland, Colo. (USA) is used when the calibration substances StabICal Solution HACH (20 NTU), StabICal Solution HACH (100 NTU) and StabICal Solution HACH (800 NTU) are used, all of which can also be produced by Hach Company. The measurement is filled with the composition to be analyzed in a 10 mL measuring cuvette having a cap and is carried out at 20° C.

At an NTU value (at 20° C.) of 60 or more, surfactant compositions have a perceptible turbidity within the meaning of the invention, as can be seen with the naked eye. It is therefore preferable for the surfactant compositions according to the invention to have an NTU value (at 20° C.) of at most 120, more preferably at most 110, even more preferably at most 100, particularly preferably at most 80.

Within the meaning of the present invention, the transparency of the solid agents according to the invention is determined by a transmission measurement in the visual light spectrum over a wavelength range of from 380 nm to 780 nm at 20° C. For this purpose, a reference sample (water, deionized) is measured in a photometer (Specord S 600 from AnalytikJena) using a cuvette (layer thickness 10 mm) which is transparent in the spectrum to be analyzed. The cuvette is then filled with a sample of the surfactant composition and measured again. In this case, the sample is introduced in a liquid state and solidified in the cuvette and then measured.

It is preferable for the transparent surfactant composition according to the invention to have a transmission (20° C.) of preferably at least 25%, more preferably at least 30%, even more preferably at least 40%, in particularly of at least 50%, particularly preferably of at least 60%.

It is very particularly preferable for the transparent surfactant composition according to the invention to have a transmission (at 20° C.) of at least 30% (in particular of at least 40%, more preferably of at least 50%, particularly preferably of at least 60%) and an NTU value (at 20° C.) of at most 120 (more preferably at most 110, even more preferably at most 100, particularly preferably at most 80).

The viscoelastic, solid surfactant composition according to the invention contains, based on the total weight thereof, a total amount of from 10 to 70 wt. % surfactant. Suitable surfactants according to the invention are preferably anionic surfactants, non-ionic surfactants, zwitterionic surfactants, amphoteric surfactants or cationic surfactants.

Preferred surfactant compositions contain, based on the total weight thereof, a total amount of from 10 to 65 wt. %, more preferably from 10 to 60 wt. %, more preferably from 15 to 70 wt. %, more preferably from 15 to 65 wt. %, more preferably from 15 to 60 wt. %, particularly preferably from 20 to 70 wt. %, more preferably from 20 to 65 wt. %, more preferably from 20 to 60 wt. %, very particularly preferably from 25 to 70 wt. %, more preferably from 25 to 65 wt. %, more preferably from 25 to 60 wt. %, even more preferably from 30 to 70 wt. %, more preferably from 30 to 65 wt. %, more preferably from 30 to 60 wt. %, of at least one surfactant. These surfactant compositions of this kind are also suitable for treating textiles; however, they are particularly suitable for use in a washing machine for textile washing. It is in turn particularly preferable for the surfactant composition to contain at least one anionic surfactant and optionally also at least one non-ionic surfactant.

A viscoelastic, solid surfactant composition that is preferred according to the invention is characterized in that it contains at least one anionic surfactant. Surfactant compositions according to the invention are suitable for washing textiles, particularly preferably for use in a washing machine for textile washing.

If the surfactant composition according to the invention contains an anionic surfactant, it is in turn preferable for said anionic surfactant to be contained in a total amount of from 5 to 70 wt. %, preferably 5 to 60 wt. %, more preferably 10 to 70 wt. %, in particular 10 to 60 wt. %, particularly preferably from 10 to 40 wt. %, even more preferably from 25 to 40 wt. %, based on the total weight of the composition.

Sulfonates and/or sulfates can preferably be used as the anionic surfactant.

Surfactants of the sulfonate type that can be used are preferably $C_{9-13}$ alkylbenzene sulfonates, olefin sulfonates, i.e. mixtures of alkene and hydroxyalkane sulfonates, and disulfonates, as obtained, for example, from $C_{12-18}$ monoolefins having a terminal or internal double bond by way of sulfonation with gaseous sulfur trioxide and subsequent alkaline or acid hydrolysis of the sulfonation products. $C_{12-18}$ alkane sulfonates and the esters of α-sulfofatty acids (ester sulfonates) are also suitable, for example the α-sulfonated methyl esters of hydrogenated coconut, palm kernel or tallow fatty acids.

Particularly preferred surfactant compositions according to the invention contain, as the anionic surfactant, at least one compound of formula (T1)

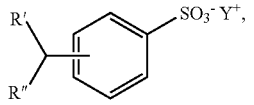

(T1)

in which

R' and R'' are, independently of one another, H or alkyl, and together contain 9 to 19, preferably 9 to 15, and in particular 9 to 13, C atoms, and $Y^+$ indicates a monovalent cation or the nth part of an n-valent cation (in particular $Na^+$).

The alkali salts, and in particular the sodium salts of the sulfuric acid half-esters of $C_{12}$-$C_{18}$ fatty alcohols, for example from coconut fatty alcohol, tallow fatty alcohol, lauryl alcohol, myristyl alcohol, cetyl alcohol or stearyl alcohol, or of $C_{10}$-$C_{20}$ oxo alcohols and the half-esters of secondary alcohols having this chain length are preferred as alk(en)yl sulfates. From a washing perspective, $C_{12}$-$C_{16}$ alkyl sulfates, $C_{12}$-$C_{18}$ alkyl sulfates and $C_{14}$-$C_{15}$ alkyl sulfates are preferred. 2,3-alkyl sulfates are also suitable anionic surfactants.

Fatty alcohol ether sulfates, such as the sulfuric acid monoesters of straight-chain or branched $C_{7-21}$ alcohols ethoxylated with 1 to 6 mol ethylene oxide, such as 2-methyl-branched $C_{9-11}$ alcohols having, on average, 3.5 mol ethylene oxide (EO) or $C_{12-18}$ fatty alcohols having 1 to 4 EO, are also suitable.

Other suitable anionic surfactants are soaps. Saturated and unsaturated fatty acid soaps are suitable, such as the salts of lauric acid, myristic acid, palmitic acid, stearic acid, (hydrogenated) erucic acid and behenic acid, and in particular soap mixtures derived from natural fatty acids, such as coconut, palm kernel, olive oil or tallow fatty acids.

The anionic surfactants, and the soaps, can be present in the form of sodium, potassium, magnesium or ammonium salts thereof. The anionic surfactants are preferably present in the form of the ammonium salts thereof. Preferred counterions for the anionic surfactants are the protonated forms of choline, triethylamine, monoethanolamine or methylethylamine.

In a very particularly preferred embodiment, the surfactant composition contains an alkyl benzene sulfonic acid, in particular $C_{9-13}$ alkyl benzene sulfonic acid, neutralized with monoethanolamine, and/or fatty acid neutralized with monoethanolamine.

A preferred surfactant composition contains at least one anionic surfactant selected from the group consisting of $C_{8-18}$ alkylbenzene sulfonates, olefin sulfonates, $C_{12-18}$ alkane sulfonates, ester sulfonates, alkyl sulfates, alkenyl sulfates, fatty alcohol ether sulfates and mixtures thereof.

In a preferred embodiment, the surfactant composition contains at least one non-ionic surfactant.

The at least one non-ionic surfactant can be any known surfactant that is suitable for the purpose according to the invention.

In a preferred embodiment of the invention, the surfactant compositions described herein contain, as a non-ionic surfactant, at least one fatty alcohol alkoxylate of the following formula (T2)

$$R'—O—(XO)_m—H \quad (T2)$$

where R' is a linear or branched $C_8$-$C_{18}$ alkyl functional group, an aryl functional group or alkylaryl functional group, XO is independently an ethylene oxide (EO) or propylene oxide (PO) group, and m is an integer from 1 to 50. In the above formula, R' represents a linear or branched, substituted or unsubstituted alkyl functional group. In a preferred embodiment of the present invention, $R^1$ is a linear or branched alkyl functional group having 5 to 30 carbon atoms, preferably 7 to 25 carbon atoms, and in particular 10 to 19 carbon atoms. Preferred functional groups R' are selected from decyl, undecyl, dodecyl, tridecyl, tetradecyl, pentadecyl, hexadecyl, heptadecyl, octadecyl, nonadecyl functional groups and mixtures thereof, the representatives having an even number of carbon atoms being preferred. Particularly preferred functional groups R' are derived from fatty alcohols having 12 to 19 carbon atoms, for example from coconut fatty alcohol, tallow fatty alcohol, lauryl, myristyl, cetyl or stearyl alcohol, or from oxo alcohols having 10 to 19 carbon atoms.

XO in formula (T2) is an ethylene oxide (EO) or propylene oxide (PO) group, preferably an ethylene oxide group.

The index m in formula (T2) is an integer from 1 to 50, preferably from 2 to 20, and more preferably from 2 to 10. In particular, m is 3, 4, 5, 6 or 7. The surfactant composition according to the invention may contain mixtures of non-ionic surfactants having different degrees of ethoxylation.

In summary, particularly preferred fatty alcohol alkoxylates are those of formula (T-3)

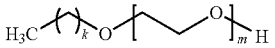

(T-3)

where k=9 to 17, and m=3, 4, 5, 6, or 7. Very particularly preferred representatives are fatty alcohols having 10 to 18 carbon atoms and 7 EO (k=11 to 17, m=7).

Fatty alcohol ethoxylates of this kind are available under the trade names Dehydol® LT7 (BASF), Lutensol® A07 (BASF), Lutensol® M7 (BASF), and Neodol® 45-7 (Shell Chemicals).

Particularly preferably, the surfactant compositions according to the invention contain non-ionic surfactants from the group of alkoxylated alcohols. Non-ionic surfactants that are preferably used are alkoxylated, advantageously ethoxylated, in particular primary alcohols having preferably 8 to 18 C atoms and, on average, 1 to 12 mol ethylene oxide (EO) per mol of alcohol, in which the alcohol functional group can be linear or preferably methyl-branched in the 2 position, or can contain linear and methyl-branched functional groups in admixture, as are usually present in oxo alcohol functional groups. However, alcohol ethoxylates having linear functional groups of alcohols of native origin having 12 to 18 C atoms, for example from coconut, palm, tallow fatty or oleyl alcohol, and an average of 2 to 8 EO per mol of alcohol, are particularly preferred. Examples of preferred ethoxylated alcohols include $C_{12-14}$ alcohols having 3 EO or 4 EO, $C_{8-11}$ alcohol having 7 EO, $C_{13-15}$ alcohols having 3 EO, 5 EO, 7 EO or 8 EO, $C_{12-18}$ alcohols having 3 EO, 5 EO or 7 EO, and mixtures thereof, such as mixtures of $C_{12-14}$ alcohol having 3 EO and $C_{12-18}$ alcohol having 5 EO.

Preferred alcohol ethoxylates have a narrowed homolog distribution (narrow range ethoxylates, NRE). In addition to these non-ionic surfactants, fatty alcohols having more than 12 EO can also be used. Examples of these are tallow fatty alcohols having 14 EO, 25 EO, 30 EO, or 40 EO.

Ethoxylated non-ionic surfactants are especially preferably used which were obtained from $C_{6-20}$ monohydroxy alkanols or $C_{6-20}$ alkyl phenols or $C_{16-20}$ fatty alcohols and more than 12 mol, preferably more than 15 mol, and in particular more than 20 mol, ethylene oxide per mol of alcohol. An especially preferred non-ionic surfactant is obtained from a straight-chain fatty alcohol having 16 to 20 carbon atoms ($C_{16-20}$ alcohol), preferably from a Cis alcohol and at least 12 mol, preferably at least 15 mol and in particular at least 20 mol, ethylene oxide. Among these, the so-called "narrow-range ethoxylates" are particularly preferred.

Surfactants that are preferably used come from the group of the alkoxylated non-ionic surfactants, in particular the ethoxylated primary alcohols and mixtures of these surfactants with structurally complex surfactants such as polyoxypropylene/polyoxyethylene/polyoxypropylene ((PO/EO/PO) surfactants). Such (PO/EO/PO) non-ionic surfactants are also characterized by good foam control.

Furthermore, the surfactant composition according to the invention may contain, as a non-ionic surfactant, amine oxide. In principle, all the amine oxides found in the prior art for this purpose, i.e. compounds that have the formula $R^1R^2R^3NO$, wherein each of $R^1$, $R^2$ and $R^3$, independently of one another, are an optionally substituted hydrocarbon chain having 1 to 30 carbon atoms can be used as the amine oxide. Amine oxides that are particularly preferably used are those in which $R^1$ is an alkyl having 12 to 18 carbon atoms and $R^2$ and $R^3$ are, independently of one another, an alkyl having 1 to 4 carbon atoms, in particular alkyl dimethyl amine oxides having 12 to 18 carbon atoms. Examples of representatives of suitable amine oxides are N-coconut alkyl-N,N-dimethyl amine oxide, N-tallow alkyl-N,N-dihydroxyethyl amine oxide, myristyl/cetyl dimethyl amine oxide or lauryl dimethyl amine oxide.

Suitable non-ionic surfactants include alkyl glycosides of general formula $RO(G)_x$, for example, in which R corresponds to a primary straight-chain or methyl-branched aliphatic functional group, in particular an aliphatic functional group that is methyl-branched in the 2 position, having 8 to 22, preferably 12 to 18, C atoms, and G is the symbol that represents a glycose unit having 5 or 6 C atoms, preferably glucose. The degree of oligomerization x, which indicates the distribution of monoglycosides and oligoglycosides, is any number between 1 and 10; x is preferably between 1.2 and 1.4.

Another class of preferably used non-ionic surfactants, which are used either as the sole non-ionic surfactant or in combination with other non-ionic surfactants, are alkoxylated, preferably ethoxylated or ethoxylated and propoxylated fatty acid alkyl esters, preferably having 1 to 4 carbon atoms in the alkyl chain.

Additional suitable surfactants are the polyhydroxy fatty acid amides that are known as PHFAs.

Other non-ionic surfactants that can be used may be, for example,

- polyol fatty acid esters,
- alkoxylated triglycerides,
- alkoxylated fatty acid alkyl esters of formula $R^3CO—(OCH_2CHR^4)_wOR^5$,
  - in which $R^3CO$ represents a linear or branched, saturated and/or unsaturated acyl functional group having 6 to 22 carbon atoms, $R^4$ represents hydrogen or methyl, and $R^5$ represents linear or branched alkyl functional groups having 1 to 4 carbon atoms, and w is 1 to 20,
- hydroxy mixed ethers,
- sorbitan fatty acid esters and addition products of ethylene oxide to sorbitan fatty acid esters such as the polysorbates,
- sugar fatty acid esters and addition products of ethylene oxide to sugar fatty acid esters, addition products of ethylene oxide to fatty acid alkanolamides and fatty amines, fatty acid-N-alkyl glucamides.

The surfactant compositions according to the invention described herein may also contain several of the non-ionic surfactants described above.

Viscoelastic, solid surfactant compositions that are particularly preferred according to the invention contain, in each case based on the total weight, a total amount of 10 to 60 wt. %, in particular 25 to 40 wt. %, of at least one anionic surfactant and 2 to 35 wt. %, preferably 18 to 28 wt. %, of at least one non-ionic surfactant.

Very particularly preferred viscoelastic, solid compositions according to the invention contain, according to the invention, in addition to water and the above-mentioned benzylidene alditol compound, at least one surfactant combination as described below for the compositions (A) to (D):

(A) viscoelastic, solid surfactant composition that contains, as a surfactant, in each case based on the total weight of the composition, at least a total amount of from 10 to 60 wt. % of at least one anionic surfactant, at least one $C_{9-13}$ alkyl benzene sulfonate being contained as an anionic surfactant, and from 2 to 35 wt. % of at least one non-ionic surfactant, at least one alkoxylated alcohol having 8 to 18 carbon atoms and on average 4 to 12 mol ethylene oxide (EO) per mol of alcohol being contained as a non-ionic surfactant.

(B) viscoelastic, solid surfactant composition that contains, as a surfactant, in each case based on the total weight of the composition, at least a total amount of from 10 to 60 wt. % of at least one anionic surfactant, at least 5 to 60 wt. % of a $C_{9-13}$ alkyl benzene sulfonate being contained as an anionic surfactant, and from 2 to 35 wt. % of at least one non-ionic surfactant, at least 2 to 35 wt. % of at least one alkoxylated alcohol having 8 to 18 carbon atoms and on average 4 to 12 mol ethylene oxide (EO) per mol of alcohol being contained as a non-ionic surfactant.

(C) viscoelastic, solid surfactant composition that contains, as a surfactant, in each case based on the total weight of the composition, at least a total amount of from 25 to 40 wt. % of at least one anionic surfactant, at least one $C_{9-13}$ alkyl benzene sulfonate being contained as an anionic surfactant, and from 18 to 28 wt. % of at least one non-ionic surfactant, at least one alkoxylated alcohol having 8 to 18 carbon atoms and on average 4 to 12 mol ethylene oxide (EO) per mol of alcohol being contained as a non-ionic surfactant.

(D) viscoelastic, solid surfactant composition that contains, as a surfactant, in each case based on the total weight of the composition, at least a total amount of from 25 to 40 wt. % of at least one anionic surfactant, at least 25 to 40 wt. % of a $C_{9-13}$ alkyl benzene sulfonate being contained as an anionic surfactant, and from 18 to 28 wt. % of at least one non-ionic surfactant, at least 18 to 28 wt. % of at least one alkoxylated alcohol having 8 to 18 carbon atoms and on average 4 to 12 mol ethylene oxide (EO) per mol of alcohol being contained as a non-ionic surfactant.

When all the above-mentioned surfactant compositions are provided with a specific amount of the selected surfactant, the amounts of the individual surfactant components must of course be selected within the specified amount ranges of the individual surfactant components, such that the predetermined total amount of surfactant is maintained.

According to the invention, it is preferable for the viscoelastic, solid surfactant composition according to the invention to contain, in addition to the anionic and non-ionic surfactant, at least one polyalkoxylated polyamine.

Within the context of the present invention and its individual aspects, the polyalkoxylated polyamine is a polymer having an N-atom-containing backbone which carries polyalkoxy groups on the N atoms. The polyamine has primary amino functions at the ends (terminus and/or side chains) and preferably both secondary and tertiary amino functions internally; optionally, it may also have merely secondary amino functions internally, such that a linear polyamine, and not a branched chain polyamine, is produced. The ratio of primary to secondary amino groups in the polyamine is preferably in the range of from 1:0.5 to 1:1.5, in particular in the range of from 1:0.7 to 1:1. The ratio of primary to tertiary amino groups in the polyamine is preferably in the range of from 1:0.2 to 1:1, in particular in the range of from 1:0.5 to 1:0.8. The polyamine preferably has an average molar mass in the range of from 500 g/mol to 50,000 g/mol, in particular from 550 g/mol to 5,000 g/mol. The N atoms in the polyamine are separated from one another by alkylene groups, preferably by alkylene groups having 2 to 12 C atoms, in particular 2 to 6 C atoms, although it is not necessary for all the alkylene groups to have the same number of C atoms. Ethylene groups, 1,2-propylene groups, 1,3-propylene groups, and mixtures thereof are particularly preferred. Polyamines which carry ethylene groups as said alkylene groups are referred to as polyethylenimine or PEI. PEI is a polymer that is particularly preferred according to the invention having an N-atom-containing backbone.

The primary amino function in the polyamine can carry 1 or 2 polyalkoxy groups and the secondary amino functions can carry 1 polyalkoxy group, it not being necessary that every amino function is alkoxy group-substituted. The average number of alkoxy groups per primary and secondary amino function in the polyalkoxylated polyamine is preferably 1 to 100, in particular 5 to 50. The alkoxy groups in the polyalkoxylated polyamine are preferably polypropoxy groups which are directly bound to N atoms, and/or polyethoxy groups which are bound to potentially present propoxy functional groups and to N atoms which do not carry propoxy groups.

Polyethoxylated polyamines are obtained by reacting polyamines with ethylene oxide (abbreviated to EO). The polyalkoxylated polyamines containing ethoxy and propoxy groups are preferably obtainable by reacting polyamines with propylene oxide (abbreviated to PO) and subsequent reaction with ethylene oxide.

The average number of propoxy groups per primary and secondary amino function in the polyalkoxylated polyamine is preferably 1 to 40, in particular 5 to 20.

The average number of ethoxy groups per primary and secondary amino function in the polyalkoxylated polyamine is preferably 10 to 60, in particular 15 to 30.

If desired, the terminal OH function polyalkoxy substituents in the polyalkoxylated polyamine can be partially or completely etherified with a $C_1$-$C_{10}$ alkyl group, in particular a $C_1$-$C_3$ alkyl group.

Polyalkoxylated polyamines which are particularly preferred according to the invention can be selected from polyamine reacted with 45EO for each primary and secondary amino function, PEIs reacted with 43EO for each primary and secondary amino function, PEIs reacted with 15EO+5PO for each primary and secondary amino function, PEIs reacted with 15PO+30EO for each primary and secondary amino function, PEIs reacted with 5PO+39.5EO for each primary and secondary amino function, PEIs reacted with 5PO+15EO for each primary and secondary amino function, PEIs reacted with 10PO+35EO for each primary and secondary amino function, PEIs reacted with 15PO+30EO for each primary and secondary amino function, and PEIs reacted with 15PO+5EO for each primary and secondary amino function. A very particularly preferred alkoxylated polyamine is PEI having a content of from 10 to 20 nitrogen atoms reacted with 20 units of EO per primary or secondary amino function of the polyamine.

A further preferred subject matter of the invention is the use of polyalkoxylated polyamines which can be obtained by reacting polyamines with ethylene oxide and optionally also propylene oxide. If polyamines polyalkoxylated using ethylene oxide and propylene oxide are used, the proportion of propylene oxide to the total amount of the alkylene oxide is preferably 2 mol. % to 18 mol. %, in particular 8 mol. % to 15 mol. %.

The viscoelastic, solid surfactant composition according to the invention preferably additionally contains, based on the weight thereof, polyalkoxylated polyamines in a total amount of from 0.5 to 12 wt. %, in particular from 5.0 to 9.0 wt. %.

In a further preferred embodiment, the viscoelastic, solid surfactant composition according to the invention additionally contains at least one soil-release active ingredient. Substances which allows the removal of dirt are often referred to as soil-release active ingredients or as soil repellents since they are capable of making the treated surface, preferably textiles, repellant to soil. Owing to their chemical similarity to polyester fibers, particularly effective active ingredients which allows the removal of dirt, but can also exhibit the desired effect on fabrics made of other materials, are copolyesters containing dicarboxylic acid units, alkylene glycol units and polyalkylene glycol units. Such polyesters which allow the removal of dirt and the use thereof, preferably in detergents for textiles, have long been known.

For example, polymers of ethylene terephthalate and polyethylene oxide terephthalate in which the polyethylene glycol units have molecular weights of from 750 to 5,000 and the molar ratio of ethylene terephthalate to polyethylene oxide terephthalate is 50:50 to 90:10 and the use thereof in detergents are described in the German patent DE 28 57 292. Polymers that have a molecular weight of from 15,000 to 50,000 and consist of ethylene terephthalate and polyethylene oxide terephthalate in which the polyethylene glycol units have molecular weights of from 1,000 to 10,000 and the molar ratio of ethylene terephthalate to polyethylene oxide terephthalate is from 2:1 to 6:1 can be used in detergents according to the German patent DE 33 24 258. European patent EP 066 944 relates to textile treatment agents containing a copolyester of ethylene glycol, polyethylene glycol, aromatic dicarboxylic acid and sulfonated aromatic dicarboxylic acid in certain molar ratios. European patent EP 185 427 discloses polyesters that are end-capped with methyl or ethyl groups and have ethylene and/or propylene terephthalate and polyethylene oxide terephthalate units, and detergents containing soil release polymers of this kind. European patent EP 241 984 relates to a polyester which, in addition to oxyethylene groups and terephthalic acid units, also contains substituted ethylene units and glycerol units. European patent EP 241 985 discloses polyesters which, in addition to oxyethylene groups and terephthalic acid units, contain 1,2-propylene, 1,2-butylene and/or 3-methoxy-1,2-propylene groups and glycerol units, and which are end-capped with $C_1$ to $C_4$ alkyl groups. European patent EP 253 567 relates to soil release polymers that have a molar mass of from 900 to 9,000 and consist of ethylene terephthalate and polyethylene oxide terephthalate, wherein the polyethylene glycol units have molecular weights of from 300 to 3,000 and the molar ratio of ethylene terephthalate to polyethylene oxide terephthalate is from 0.6 to 0.95. European patent application EP 272 033 discloses polyesters that are end-capped at least in portions with $C_{1-4}$ alkyl or acyl functional groups and that have polypropylene terephthalate and polyoxyethylene terephthalate units. European patent EP 274 907 describes sulfoethyl-end-capped soil release polyesters containing terephthalate. In European patent application EP 357 280, soil-release polyesters having terephthalate, alkylene glycol and poly-$C_{2-4}$ glycol units are produced by sulfonation of unsaturated end groups.

In a preferred embodiment of the invention, the surfactant composition according to the invention contains at least one polyester which allows the removal of dirt and contains the structural units EI to E-III or EI to E-IV,

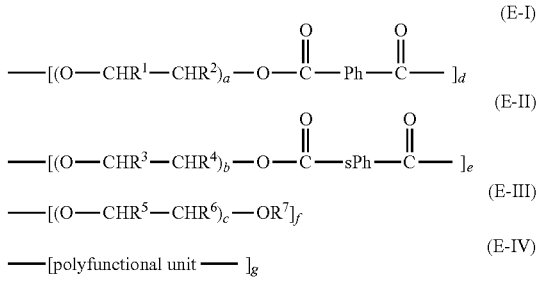

(E-I)

(E-II)

(E-III)

(E-IV)

in which a, b and c each represent, independently of one another, a number from 1 to 200, d, e and f each represent, independently of one another, a number from 1 to 50, g represents a number from 0 to 5, Ph represents a 1,4-phenylene functional group, sPh represents a 1,3-phenylene functional group substituted with a —$SO_3M$ group in position 5, M represents Li, Na, K, Mg/2, Ca/2, Al/3, ammonium, mono-, di-, tri- or tetraalkylammonium, the alkyl function groups of the ammonium ions being $C_1$-$C_{22}$ alkyl functional groups or $C_2$-$C_{10}$ hydroxyalkyl functional groups or any desired mixtures thereof, $R^1$, $R^2$, $R^3$, $R^4$, $R^5$ und $R^6$ each represent, independently of one another, hydrogen or a $C_1$-$C_{18}$ n- or iso-alkyl group, $R^7$ represents a linear or branched $C_1$-$C_{30}$ alkyl group or a linear or branched $C_2$-$C_{30}$ alkenyl group, a cycloalkyl group having 5 to 9 carbon atoms, a $C_6$-$C_{30}$ aryl group or a $C_6$-$C_{30}$ arylalkyl group, and polyfunctional unit represents a unit having 3 to 6 functional groups capable of an esterification reaction.

Preference is given to those polyesters in which $R^1$, $R^2$, $R^3$, $R^4$, $R^5$ and $R^6$ are each, independently of one another, hydrogen or methyl, $R^7$ represents methyl, a, b and c are each, independently of one another, a number from 1 to 200, in particular 1 to 20, particularly preferably 1 to 5, very preferably a and b=1 and c can be a number from 2 to 10, d is a number between 1 and 25, in particular between 1 and 10, particularly preferably between 1 and 5, e is a number between 1 and 30, in particular between 2 and 15, particularly preferable between 3 and 10, and f is a number between 0.05 and 15, in particular between 0.1 and 10, and particularly preferably between 0.25 and 3. Polyesters of this kind can be obtained, for example, by polycondensation of terephthalic acid dialkyl ester, 5-sulfoisophthalic acid dialkyl ester, alkylene glycols, optionally polyalkylene glycols (where a, b and/or c>1) and polyalkylene glycols capped at one end (corresponding to unit E-III). It should be noted that, for numbers a, b, c>1, there is a polymer backbone and thus the coefficients can assume, as an average, any value within the specified interval. This value reflects the number average molecular weight. An ester of terephthalic acid having one or more difunctional, aliphatic alcohols is considered as unit (E-I). Ethylene glycol ($R^1$ and $R^2$ each being H) and/or 1,2-propylene glycol ($R^1$=H and $R^2$=—$CH_3$ or vice versa) and/or shorter-chain polyethylene glycols and/or poly[ethylene glycol-co-propylene glycol] having number average molecular weights of from 100 to 2,000 g/mol are preferably used in this case. The structures can contain, for example, 1 to 50 units (E-I) per polymer chain. An ester of 5-sulfoisophthalic acid having one or more difunctional, aliphatic alcohols is considered as unit (E-II). The above-mentioned esters are preferably used in this case. There can be, for example, 1 to 50 units (E-II) in the structures. Poly[ethylene glycol-co-propylene glycol]-monomethyl ethers having average molecular weights of from 100 to 2,000 g/mol and polyethylene glycol monomethyl ethers of the general formula $CH_3$—O—$(C_2H_4O)_n$—H, where n=1 to 99, in particular 1 to 20, and particularly preferably 2 to 10, are preferably used as polyalkylene glyocol monoalkyl ethers according to unit (E-III) that are non-ionically capped at one end. Since the theoretical maximum average molecular weight, to be achieved using quantitative conversion, of a polyester structure is specified by the use of such ethers capped at one end, the preferred use amount of structural unit (E-III) is that which is necessary to achieve the average molecular weights described below. With the exception of linear polyesters which result from the structural units (E-I), (E-II) and (E-III), the use of crosslinked or branched polyester structures is also according to the invention. This is expressed by the presence of a crosslinking polyfunctional structural unit (E-IV) having at least three to at most 6 functional groups capable of an esterification reaction. Acid, alcohol, ester, anhydride, or epoxy groups, for example, can be named as functional groups in this case. Different functionalities in one molecule are also possible. Examples of this are citric acid, malic acid, tartaric acid and gallic acid, particularly preferably 2,2-dihydroxymethylpropionic acid. Polyvalent alcohols such as pentaerythrol, glycerol, sorbitol and/or trimethylolpropane can also be used. These can also be polyvalent aliphatic or aromatic carboxylic acids, such as benzene-1,2,3-tricarboxylic acid (hemimellitic acid), benzene-1,2,4-tricarboxylic acid (trimellitic acid), or benzene-1,3,5-tricarboxylic acid (trimesic acid). The weight proportion of crosslinking monomers, based on the total mass of the polyester, can be up to 10 wt. %, in particular up to 5 wt. %, and particularly preferably up to 3 wt. %, for example. The polyesters, containing the structural units (E-I), (E-II) and (E-III) and optionally (E-IV), generally have number average molecular weights in the range of from 700 to 50,000 g/mol, it being possible to determine the number average molecular weight by means of size-exclusion chromatography in an aqueous solution, using calibration with reference to closely distributed polyacrylic acid sodium salt standards. Preferably, the number average molecular weights are in the range of from 800 to 25,000 g/mol, in particular 1,000 to 15,000 g/mol, particularly preferably 1,200 to 12,000 g/mol. Preferably, solid polyesters having softening points above 40° C. are used according to the invention as a component of the particle of the second type; said polyesters preferably have a softening point of between 50 and 200° C., particularly preferably between 80° C. and 150° C., and extremely preferably between 100° C. and 120° C. The polyesters can be synthesized according to known methods, for example by the above-mentioned components first being heated at normal pressure by adding a catalyst and then forming the required molecular weights in the vacuum by hyperstoichiometric amounts of the glycols used being distilled off. The known transesterification and condensation catalysts, such as titanium tetraisopropylate, dibutyltin oxide, alkaline or alkaline earth metal alcoholates, or antimony trioxide/calcium acetate, are suitable for the reaction. Reference is made to EP 442 101 for further details.

The viscoelastic, solid surfactant composition can additionally contain at least one enzyme. In principle, all the enzymes found in the prior art for this purpose can be used for treating textiles. This at least one enzyme is preferably one or more enzymes which can develop catalytic activity in a surfactant-containing liquor, in particular a protease, amylase, lipase, cellulase, hemicellulase, mannanase, pectin-cleaving enzyme, tannase, xylanase, xanthanase, ß-glucosidase, carrageenanase, perhydrolase, oxidase, oxidoreductase and mixtures thereof. Hydrolytic enzymes that are preferably suitable include in particular proteases, amylases, in particular α-amylases, cellulases, lipases, hemicellulases, in particular pectinases, mannanases, ß-glucanases, and mixtures thereof. Proteases, amylases and/or lipases and mixtures thereof are particularly preferred, and proteases are more particularly preferred. In principle, these enzymes are of natural origin; proceeding from the natural molecules, improved variants for use in washing or cleaning agents are available which are preferably used accordingly.

Among the proteases, the subtilisin-type proteases are preferred. Examples of these are the subtilisins BPN' and Carlsberg, protease PB92, subtilisins 147 and 309, the alkaline protease from *Bacillus lentus*, subtilisin DY, and the enzymes thermitase, proteinase K and proteases TW3 and TW7, which belong to the subtilases but no longer to the subtilisins in the narrower sense. Subtilisin Carlsberg is available in a developed form under the trade name Alcalase® from Novozymes A/S, Bagsvaerd, Denmark. Subtilisins 147 and 309 are marketed by Novozymes under the trade names Esperase® and Savinase®, respectively. The protease variants marketed under the name BLAP® are derived from the protease from *Bacillus lentus* DSM 5483. Other proteases that can be used are, for example, the enzymes available under the trade names Durazym®, Relase®, Everlase®, Nafizym®, Natalase®, Kannase® and Ovozymes® from Novozymes, the enzymes available under the trade names Purafect®, Purafect® OxP, Purafect® Prime, Excellase® and Properase® from Genencor, the enzyme available under the trade name Protosol® from Advanced Biochemicals Ltd., Thane, India, the enzyme available under the trade name Wuxi® from Wuxi Snyder Bioproducts Ltd., China, the enzymes available under the trade names Proleather® and Protease P® from Amano Pharmaceuticals Ltd., Nagoya, Japan, and the enzyme available under the name Proteinase K-16 from Kao Corp., Tokyo, Japan. The proteases from *Bacillus gibsonii* and *Bacillus pumilus* are particularly preferably used.

Examples of amylases that can be used according to the invention are the α-amylases of *Baciullus licheniformus*, of *B. amyloliquefaciens*, or of *B. stearothermophilus*, and the developments thereof that are improved for use in washing or cleaning agents. The enzyme from *B. licheniformis* is available from Novozymes under the name Termamyl® and from Genencor under the name Purastar®ST. Development products of this α-amylase are available from Novozymes under the trade names Duramyl® and Termamyl®ultra, from Genencor under the name Purastar®OxAm, and from Daiwa Seiko Inc., Tokyo, Japan, as Keistase®. The α-amylase from *B. amyloliquefaciens* is marketed by Novozymes under the name BAN®, and derived variants from the α-amylase from *B. stearothermophilus* are marketed under the names BSG® and Novamyl®, also by Novozymes. Others that are particularly noteworthy for this purpose are the α-amylases from *Bacillus* sp. A 7-7 (DSM 12368) and cyclodextrin glucanotransferase (CGTase) from *B. agaradherens* (DSM 9948). Fusion products of all the molecules mentioned can also be used. Furthermore, the developments of the α-amylase from *Aspergillus niger* and *A. oryzae*, available under the trade name Fungamyl® from Novozymes, are suitable. Other trade products that can advantageously be used are, for example, Amylase-LT®, and Stainzyme® or Stainzyme Ultra® or Stainzyme Plus®, the latter also from Novozymes. Variants of these enzymes which are obtained by means of point mutation can also be used according to the invention.

Examples of lipases or cutinases that can be used according to the invention, which are contained in particular due to their triglyceride-cleaving activities, but also in order to produce peracids in situ from suitable precursors, are the lipases that can be originally obtained or developed from *Humicola lanuginosa* (*Thermomyces lanuginosis*), in particular those with the amino acid exchange D96L. These are marketed for example by Novozymes under the trade names Lipolase®, Lipolase®Ultra, LipoPrime®, Lipozyme® and Lipex®. Furthermore, the cutinases that have been isolated originally from *Fusarium solani pisi* and *Humicola insolens* can be used, for example. Lipases that can also be used are available from Amano under the names Lipase CE®, Lipase P®, Lipase B®, and Lipase CES®, Lipase AKG®, *Bacillus* sp. Lipase®, Lipase AP®, Lipase M-AP® and Lipase AML®. From Genencor, the lipases or cutinases of which the starting enzymes have been isolated originally from *Pseudomonas mendocina* and *Fusarium solanii* can be used, for example. The preparations M1 Lipase® and Lipomax® originally marketed by Gist-Brocades, the enzymes marketed by Meito Sangyo KK, Japan, under the names Lipase MY-30®, Lipase OF® and Lipase PL®, and the product Lumafast® from Genencor should be mentioned as other important commercial products.

Cellulases can be present as pure enzymes, as enzyme preparations, or in the form of mixtures in which the individual components are advantageously complementary in terms of their different performance aspects, in particular in portions for textile washing. These performance aspects include in particular the contributions of the cellulase to the primary washing performance of the agent (cleaning performance), to the secondary washing performance of the agent (anti-redeposition effect or graying inhibition), to softening (fabric effect), or to providing a "stone-washed" effect. A usable fungal cellulase preparation that is rich in endoglucanase (EG) and the developments thereof are provided by Novozymes under the trade name Celluzyme®. The products Endolase® and Carezyme®, which are also available from Novozymes, are based on the 50 kD EG and the 43 kD EG, respectively, of *H. insolens* DSM 1800. Other commercial products from this company that can be used are Renozyme® and Celluclean®. It is also possible to use the cellulase 20 kD-EG from *Melanocarpus*, which is available from AB Enzymes, Finland, under the trade names Ecostone® and Biotouch®. Further trade products from AB Enzymes are Econase® and Ecopulp®. Other suitable cellulases are from *Bacillus* sp. CBS 670.93 and CBS 669.93, the cellulase from *Bacillus* sp. CBS 670.93 being available from Genencor under the trade name Puradax®. Other commercial products from Genencor are "Genencor detergent cellulase L" and IndiAge Neutra. Variants of these enzymes which are obtained by means of point mutation can also be used according to the invention. Particularly preferred cellulases are *Thielavia terrestris* cellulase variants, cellulases from *Melanocarpus*, in particular *Melanocarpus albomyces*, EGIII-type cellulases from *Trichoderma reesei*, or variants that can be obtained therefrom.

Furthermore, other enzymes which can be grouped together under the term "hemicellulases" can be used to remove specific problematic stains on the substrate. These include, for example, mannanases, xanthan lyases, xanthanases, xyloglucanases, xylanases, pullulanases, pectin-cleaving enzymes, and 3-glucanases. The β-glucanase obtained from *Bacillus subtilis* is available from Novozymes under the name Cereflo®. Hemicellulases that are particularly preferred according to the invention are mannanases which are marketed, for example, under the trade names Mannaway® by Novozymes or Purabrite® by Genencor. Within the context of the present invention, the pectin-cleaving enzymes also include enzymes having the names pectinase, pectate lyase, pectin esterase, pectin demethoxylase, pectin methoxylase, pectin methylesterase, pectase, pectin methylesterase, pectinesterase, pectin pectyl hydrolase, pectin depolymerase, endopolygalacturonase, pectolase, pectin hydrolase, pectin polygalacturonase, endopolygalacturonase, poly-α-1,4-galacturonide, glycanohydrolase, endogalacturonase, endo-D-galacturonase, galacturan 1,4-α-galacturonidase, exopolygalacturonase, poly(galacturonate) hydrolase, exo-D-galacturonase, exo-D-galacturonanase, exopoly-D-galacturonase, exo-poly-α-galacturonosidase, exopolygalacturonosidase, or exopolygalacturanosidase. Examples of enzymes that are suitable in this regard are available for example under the names Gamanase®, Pektinex AR®, X-Pect® or Pectaway® from Novozymes, under the names Rohapect UF®, Rohapect TPL®, Rohapect PTE100®, Rohapect MPE®, Rohapect MA plus HC, Rohapect DA12L®, Rohapect 10L®, Rohapect B1L® from AB Enzymes, and under the name Pyrolase® from Diversa Corp., San Diego, Calif., USA.

Of all these enzymes, particularly preferred are those which have been stabilized in a comparatively stable manner against oxidation or by means of point mutagenesis, for example.

This includes in particular the above-mentioned trade products Everlase® and Purafect®OxP as examples for proteases of this kind and Duramyl® as an example for an α-amylase of this kind.

The viscoelastic, solid surfactant composition according to the invention contains enzymes preferably in total amounts of from $1\times10^{-8}$ to 5 wt. % based on active protein. Preferably, the enzymes are contained in this portion in a total amount of from 0.001 to 2 wt. %, more preferably from 0.01 to 1.5 wt. %, even more preferably from 0.05 to 1.25 wt. %, and particularly preferably from 0.01 to 0.5 wt. %.

Moreover, builders, complexing agents, optical brighteners (preferably in portions for washing textiles), pH adjusters, perfume, dye, dye transfer inhibitors, or mixtures thereof can be contained in the surfactant composition according to the invention as additional ingredients.

The use of builder substances (builders) such as silicates, aluminum silicates (in particular zeolites), salts of organic di- and polycarboxylic acids, as well as mixtures of these substances, preferably water-soluble builder substances, can be advantageous.

In an embodiment that is preferred according to the invention, the use of phosphates (including polyphosphates) is omitted either largely or completely. In this embodiment, the viscoelastic, solid agent according to the invention contains preferably less than 5 wt. %, particularly preferably less than 3 wt. %, more particularly preferably less than 1 wt. %, phosphate(s). Particularly preferably, the surfactant composition according to the invention is completely phosphate-free in this embodiment, i.e. the compositions contain less than 0.1 wt. % phosphate(s).

The builders include, in particular, carbonates, citrates, phosphonates, organic builders, and silicates. The proportion by weight of the total builders with respect to the total weight of the viscoelastic, solid composition according to the invention is preferably 15 to 80 wt. % and in particular 20 to 70 wt. %.

Some examples of organic builders that are suitable according to the invention are the polycarboxylic acids (polycarboxylates) that can be used in the form of their sodium salts, with polycarboxylic acids being understood to mean those carboxylic acids that carry more than one, in particular two to eight, acid functions, preferably two to six, in particular two, three, four, or five, acid functions in the entire molecule. Dicarboxylic acids, tricarboxylic acids, tetracarboxylic acids, and pentacarboxylic acids, in particular di-, tri-, and tetracarboxylic acids, are thus preferred as polycarboxylic acids. The polycarboxylic acids can also carry additional functional groups such as hydroxyl or amino groups, for example. For example, these include citric acid, adipic acid, succinic acid, glutaric acid, malic acid, tartaric acid, maleic acid, fumaric acid, sugar acids (preferably aldaric acids, for example galactaric acid and glucaric acid), aminocarboxylic acids, in particular aminodicarboxylic acids, aminotricarboxylic acids, aminotetracarboxylic acids such as, for example, nitrilotriacetic acid (NTA), glutamic-N,N-diacetic acid (also called N,N-bis(carboxymethyl)-L-glutamic acid or GLDA), methyl glycine diacetic acid (MGDA), and derivatives thereof and mixtures thereof. Preferred salts are the salts of the polycarboxylic acids such as citric acid, adipic acid, succinic acid, glutaric acid, tartaric acid, GLDA, MGDA, and mixtures thereof.

Other substances that are suitable as organic builders are polymeric polycarboxylates (organic polymers with a plurality of (in particular greater than ten) carboxylate functions in the macromolecule), polyaspartates, polyacetals, and dextrins.

Besides their building effect, the free acids also typically have the property of an acidifying component. Particularly noteworthy here are citric acid, succinic acid, glutaric acid, adipic acid, gluconic acid, and any mixtures thereof.

Particularly preferred surfactant compositions contain, as one of their essential builders, one or more salts of citric acid, i.e. citrates. These are contained preferably in a proportion of from 0.3 to 10 wt. %, in particular from 0.5 to 8 wt. %, particularly from 0.7 to 6.0 wt. %, particularly preferably 0.8 to 5.0 wt. %, in each case based on the total weight of the composition.

It is also particularly preferred to use carbonate(s) and/or hydrogen carbonate(s), preferably alkali carbonate(s), particularly preferably sodium carbonate (soda), in amounts of from 2 to 50 wt. %, preferably from 4 to 40 wt. %, and in particular from 10 to 30 wt. %, very particularly preferably from 10 to 24 wt. %, in each case based on the weight of the viscoelastic, solid surfactant composition.

The viscoelastic, solid surfactant compositions according to the invention can contain phosphonates in particular as an additional builder. A hydroxy alkane and/or amino alkane phosphonate is preferably used as a phosphonate compound. Among the hydroxy alkane phosphonates, 1-hydroxyethane-1,1-diphosphonate (HEDP) has special significance. Ethylenediamine tetramethylene phosphonate (EDTMP), diethylene triamine pentamethylene phosphonate (DTPMP) and higher homologs thereof are preferably considered as amino alkane phosphonates. Phosphonates are preferably contained in viscoelastic, solid surfactant compositions according to the invention in amounts of from 0.1 to 10 wt. %, in particular in amounts of from 0.3 to 8 wt. %, very particularly preferably from 0.5 to 4.0 wt. %, in each case based on the total weight of the composition.

Polymeric polycarboxylates are also suitable as organic builders. These are, for example, the alkali metal salts of polyacrylic acid or polymethacrylic acid, for example those having a relative molecular mass of from 500 to 70,000 g/mol. Suitable polymers are in particular polyacrylates which preferably have a molecular mass of from 1,000 to 20,000 g/mol. Due to their superior solubility, the short-chain polyacrylates, which have molar masses of from 1,100 to 10,000 g/mol, and particularly preferably from 1,200 to 5,000 g/mol, can be preferred from this group.

The viscoelastic, solid surfactant compositions according to the invention can also contain, as a builder, crystalline layered silicates of general formula $NaMSi_xO_{2x+1}.y\ H_2O$, where M represents sodium or hydrogen, x is a number from 1.9 to 22, preferably from 1.9 to 4, with 2, 3, or 4 being particularly preferred values for x, and y represents a number from 0 to 33, preferably from 0 to 20. It is also possible to use amorphous sodium silicates with a $Na_2O:SiO_2$ modulus of 1:2 to 1:3.3, preferably 1:2 to 1:2.8, and particularly 1:2 to 1:2.6, which preferably have retarded dissolution and secondary washing properties.

An optical brightener is preferably selected from the substance classes of distyrylbiphenyls, stilbenes, 4,4'-diamino-2,2'-stilbene disulfonic acids, cumarines, dihydroquinolones, 1,3-diarylpyrazolines, naphthalic acid imides, benzoxazole systems, benzisoxazole systems, benzimidazole systems, pyrene derivatives substituted with heterocycles, and mixtures thereof.

Particularly preferred optical brighteners include disodium-4,4'-bis-(2-morpholino-4-anilino-s-triazin-6-ylamino) stilbene disulfonate (for example available as Tinopal® DMS from BASF SE), disodium-2,2'-bis-(phenyl-styryl) disulfonate (for example available as Tinopal® CBS from BASF SE), 4,4'-bis[(4-anilino-6-[bis(2-hydroxyethyl) amino]-1,3,5-triazin-2-yl)amino]stilbene-2,2'-disulfonic acid (for example available as Tinopal® UNPA from BASF SE), hexasodium-2,2'-vinylenebis[(3-sulphonato-4,1-phenylene)imino[6-(diethylamino)-1,3,5-triazin-4,2-diyl] imino]]bis-(benzene-1,4-disulfonate) (for example available as Tinopal® SFP from BASF SE), 2,2'-(2,5-thiophendiyl) bis[5-1,1-dimethylethyl)-benzoxazole (for example available as Tinopal® SFP from BASF SE) and/or 2,5-bis(benzoxazol-2-yl)thiophene.

It is preferable for the dye transfer inhibitor to be a polymer or a copolymer of cyclic amines such as vinylpyrrolidone and/or vinylimidazole. Polymers suitable as a dye transfer inhibitor include polyvinylpyrrolidone (PVP), polyvinylimidazole (PVI), copolymers of vinylpyrrolidone and vinylimidazole (PVP/PVI), polyvinylpyridine-N-oxide, poly-N-carboxymethyl-4-vinylpyridium chloride, polyethylene glycol-modified copolymers of vinylpyrrolidone and vinylimidazole, and mixtures thereof. Particularly preferably, polyvinylpyrrolidone (PVP), polyvinylimidazole (PVI) or copolymers of vinylpyrrolidone and vinylimidazole (PVP/PVI) are used as a dye transfer inhibitor. The polyvinylpyrrolidones (PVP) used preferably have an average molecular weight of from 2,500 to 400,000 and are commercially available from ISP Chemicals as PVP K 15, PVP K 30, PVP K 60 or PVP K 90, or from BASF as Sokalan® HP 50 or Sokalan® HP 53. The copolymers of vinylpyrrolidone and vinylimidazole (PVP/PVI) used preferably have a molecular weight in the range of from 5,000 to 100,000. A PVP/PVI copolymer is commercially available from BASF under the name Sokalan® HP 56, for example. Other dye transfer inhibitors that can be extremely preferably used are polyethylene glycol-modified copolymers of vinylpyrrolidone and vinylimidazole, which for example are available from BASF under the name Sokalan® HP 66.

Within the context of an embodiment that is preferred according to the invention, the viscoelastic, solid surfactant composition according to the invention contains incorporated solid particles (also referred to as particles in the following). Dispersed solid particles of this kind are understood to be solid substances that do not dissolve in the liquefied phase of the surfactant composition according to the invention at temperatures of up to 5° C. units above the sol-gel temperature of the solid surfactant composition according to the invention and are present as a separate phase. These particles are suspended in the liquid phase above the sol-gel temperature when the viscoelastic surfactant compositions according to the invention are prepared and subsequently the liquid phase is cooled to below the sol-gel temperature in order to obtain the viscoelastic surfactant composition according to the invention.

The solid particles are preferably selected from polymers, pearlescing pigments, microcapsules, speckles, or mixtures thereof.

Within the meaning of the present invention, microcapsules include any type of capsule known to a person skilled in the art, but in particular core-shell capsules and matrix capsules. Matrix capsules are porous shaped bodies that have a structure similar to a sponge. Core-shell capsules are shaped bodies that have a core and a shell. Capsules that have an average diameter $X_{50.3}$ (volume average) of from 0.1 to 200 μm, preferably from 1 to 100 μm, more preferably from 5 to 80 μm, particularly preferably from 10 to 50 μm and in particular from 15 to 40 μm, are suitable as microcapsules. The average particle size diameter $X_{50.3}$ is determined by sieving or by means of a Camsizer particle size analyzer from Retsch.

The microcapsules of the invention preferably contain at least one active ingredient, preferably at least one odorant. These preferred microcapsules are perfume microcapsules.

In a preferred embodiment of the invention, the microcapsules have a semi-permeable capsule wall (shell).

A semi-permeable capsule wall within the meaning of the present invention is a capsule wall that is semi-permeable, i.e. continuously releases small quantities of the capsule core over time, without the capsules e.g. being destroyed or opened e.g. by tearing. These capsules continuously release small quantities of the active ingredient contained in the capsule, e.g. perfume, over a long period of time.

In another preferred embodiment of the invention, the microcapsules have an impermeable shell. An impermeable shell within the meaning of the present invention is a capsule wall that is substantially not permeable, i.e. releases the capsule core only by the capsule being damaged or opened. These capsules contain significant quantities of the at least one odorant in the capsule core, and therefore when the capsule is damaged or opened, a very intense fragrance is provided. The fragrance intensities thus achieved are generally so high that lower quantities of the microcapsules can be used in order to achieve the same fragrance intensity as for conventional microcapsules.

In a preferred embodiment of the invention, the surfactant composition according to the invention contains both microcapsules having a semipermeable shell and microcapsules having an impermeable shell. By using both types of capsule, a significantly improved fragrance intensity can be provided over the entire laundry cycle.

In another preferred embodiment of the invention, the composition according to the invention may also contain two or more different microcapsule types having semipermeable or impermeable shells.

High-molecular compounds are usually considered as materials for the shell of the microcapsules, such as protein compounds, for example gelatin, albumin, casein and others, cellulose derivatives, for example methylcellulose, ethylcellulose, cellulose acetate, cellulose nitrate, carboxymethylcellulose and others, and especially also synthetic polymers such as polyamides, polyethylene glycols, polyurethanes, epoxy resins and others. Preferably, melamine formaldehyde polymers, melamine urea polymers, melamine urea formaldehyde polymers, polyacrylate polymers or polyacrylate copolymers are used as the wall material, i.e. as the shell. Capsules according to the invention are for example, but not exclusively, described in US 2003/0125222 A1, DE 10 2008 051 799 A1 or WO 01/49817.

Preferred melamine formaldehyde microcapsules are prepared by melamine formaldehyde precondensates and/or the $C_1$-$C_4$ alkyl ether thereof in water, by the at least one odor modulator compound and optionally other ingredients, such as at least one odorant, condensing in the presence of a protective colloid. Suitable protective colloids are e.g. cellulose derivatives, such as hydroxyethyl cellulose, carboxymethyl cellulose and methylcellulose, polyvinylpyrrolidone, copolymers of N-vinylpyrrolidone, polyvinyl alcohols, partially hydrolyzed polyvinyl acetates, gelatin, arabic gum, xanthan gum, alginates, pectins, degraded starches, casein, polyacrylic acid, polymethacrylic acid, copolymerisates of acrylic acid and methacrylic acid, sulfonic-acid-group-containing water-soluble polymers having a content of sulfoethyl acrylate, sulfoethyl methacrylate or sulfopropyl methacrylate, and polymerisates of N-(sulfoethyl)-maleinimide, 2-acrylamido-2-alkyl sulfonic acids, styrene sulfonic acids and formaldehyde and condensates of phenol sulfonic acids and formaldehyde.

It is preferable for the surface of the microcapsules used according to the invention to be coated entirely or in part with at least one cationic polymer. Accordingly, at least one cationic polymer from the group comprising polyquaternium-1, polyquaternium-2, polyquaternium-4, polyquaternium-5, polyquaternium-6, polyquaternium-7, polyquaternium-8, polyquaternium-9, polyquaternium-10, polyquaternium-11, polyquaternium-12, polyquaternium-13, polyquaternium-14, polyquaternium-15, polyquaternium-16, polyquaternium-17, polyquaternium-18, polyquaternium-19, polyquaternium-20, polyquaternium-22, polyquaternium-24, polyquaternium-27, polyquaternium-28, polyquaternium-29, polyquaternium-30, polyquaternium-31, polyquaternium-32, polyquaternium-33, polyquaternium-34, polyquaternium-35, polyquaternium-36, polyquaternium-37, polyquaternium-39, polyquaternium-43, polyquaternium-44, polyquaternium-45, polyquaternium-46, polyquaternium-47, polyquaternium-48, polyquaternium-49, polyquaternium-50, polyquaternium-51, polyquaternium-56, polyquaternium-57, polyquaternium-61, polyquaternium-69 or polyquaternium-86 is suitable as a cationic polymer for coating the microcapsules. Polyquaternium-7 is very particularly preferred. The polyquaternium nomenclature used in this application for the cationic polymers is taken from the declaration for cationic polymers according to the International Nomenclature of Cosmetic Ingredients (INCI declaration) for cosmetic raw materials.

Microcapsules that can preferably be used have an average diameter $X_{50.3}$ in the range of from 1 to 100 μm, preferably from 5 to 95 μm, in particular from 10 to 90 μm, for example from 10 to 80 μm.

The shell of the microcapsules surrounding the core or the (filled) cavity preferably has an average thickness in the range of approximately 5 to 500 nm, preferably of approximately 50 nm to 200 nm, in particular of approximately 70 nm to approximately 180 nm.

Pearlescing pigments are pigments that have a pearlescent shine. Pearlescing pigments consist of thin sheets that have a high refraction index, and partially reflect the light and are partially transparent to the light. The pearlescent shine is generated by interference of the light hitting the pigment (interference pigment). Pearlescing pigments are usually thin sheets of the above-mentioned material, or contain the above-mentioned material as thin, multilayered films or as components arranged in parallel in a suitable carrier material.

The pearlescing pigments that can be used according to the invention are either natural pearlescing pigments such as fish silver (guanine/hypoxanthine mixed crystals from fish scales) or mother of pearl (from ground seashells), monocrystalline, sheet-like pearlescing pigments such as bismuth oxychloride and pearlescing pigments with a mica base and a mica/metal oxide base. The latter pearlescing pigments are mica that has been provided with a metal oxide coating.

By using the pearlescing pigments in the suspension according to the invention, shine and optionally also color effects are achieved.

Pearlescing pigments with a mica base and mica/metal oxide base are preferred according to the invention. Mica is a phyllosilicate. The most important representatives of these silicates are muscovite, phlogopite, paragonite, biotite, lepidolite, and margarite. In order to produce the pearlescing pigments in conjunction with metal oxides, mica, primarily muscovite or phlogopite, is coated with a metal oxide. Suitable metal oxides are, inter alia, $TiO_2$, $Cr_2O_3$, and $Fe_2O_3$. Interference pigments and colored luster pigments are obtained as pearlescing pigments according to the invention by suitable coating. These pearlescing pigment types additionally have color effects in addition to a glittering optical effect. Furthermore, the pearlescing pigments that can be used according to the invention also contain a color pigment that does not derive from a metal oxide.

The grain size of the pearlescing pigments that are preferably used is preferably between 1.0 μm and 100 μm, particularly preferably between 10.0 and 60.0 μm, at an average diameter $X_{50.3}$ (volume average).

Within the meaning of the invention, speckles are understood to mean macroparticles, in particular macrocapsules, that have an average diameter $X_{50.3}$ (volume average) of more than 300 μm, in particular of from 300 to 1.500 μm, preferably from 400 to 1.000 μm.

Speckles are preferably matrix capsules. The matrix is preferably colored. The matrix is formed for example by gelation, polyanion-polycation interactions or polyelectrolyte-metal ion interactions, and this is well known in the prior art, just like the preparation of particles using these matrix-forming materials. An example of a matrix-forming material is alginate. In order to prepare alginate-based speckles, an aqueous alginate solution, optionally also containing the active ingredient or active ingredients to be included, is drop-formed and is then hardened in a precipitation bath containing $Ca^{2+}$ ions or $Al^{3+}$ ions. Alternatively, other matrix-forming materials may be used instead of alginate.

The viscoelastic, solid surfactant composition necessarily contains, based on the total weight of the composition, a total amount of more than 1 wt. % of the above-mentioned benzylidene alditol. Due to the stereochemistry of the alditols, it should be mentioned that benzylidene alditols according to the invention and as described above are suitable in the L configuration or in the D configuration of a mixture of the two. Due to natural availability, the benzylidene alditol compounds are preferably used according to the invention in the D configuration. It has proven preferable for the alditol backbone of the benzylidene alditol compound according to formula (I) contained in the surfactant composition to be derived from D-glucitol, D-mannitol, D-arabinitol, D-ribitol, D-xylitol, L-glucitol, L-mannitol, L-arabinitol, L-ribitol, or L-xylitol.

Particularly preferred are surfactant compositions which are characterized in that $R^1$, $R^2$, $R^3$, $R^4$, $R^5$ and $R^6$ according to the benzylidene alditol compound of formula (I) mean, independently of one another, a hydrogen atom, methyl, ethyl, chlorine, fluorine, or methoxy, preferably a hydrogen atom.

n according to benzylidene alditol compound of formula (I) preferably represents 1.

m according to benzylidene alditol compound formula (I) preferably represents 1.

Very particularly preferably, the surfactant composition according to the invention contains, as a benzylidene alditol compound of formula (I), at least one compound of formula (I-1)

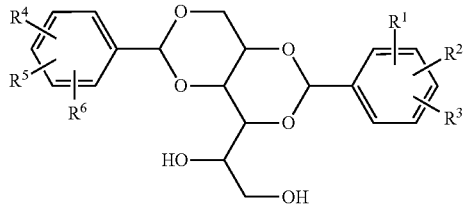

(I-1)

in which $R^1$, $R^2$, $R^3$, $R^4$, $R^5$ and $R^6$ are as defined in the appended claims. Most preferably, according to formula (I-1) $R^1$, $R^2$, $R^3$, $R^4$, $R^5$ and $R^6$ represent, independently of one another, a hydrogen atom, methyl, ethyl, chlorine, fluorine, or methoxy, preferably a hydrogen atom.

Most preferably, the benzylidene alditol compound of formula (I) is selected from 1,3:2,4-di-O-benzylidene-D-sorbitol; 1,3:2,4-di-O-(p-methylbenzylidene)-D-sorbitol; 1,3:2,4-di-O-(p-chlorobenzylidene)-D-sorbitol; 1,3:2,4-di-O-(2,4-dimethylbenzylidene)-D-sorbitol; 1,3:2,4-di-O-(p-ethylbenzylidene)-D-sorbitol; 1,3:2,4-di-O-(3,4-dimethylbenzylidene)-D-sorbitol, or mixtures thereof.

The benzylidene alditol compound of formula (I) contained in the viscoelastic, solid surfactant composition is contained, based on the total weight of the composition, preferably in a total amount of more than 1.5 wt. %, in particular of more than 2.0 wt. %. Particularly preferably, the benzylidene alditol compound of formula (I) contained in the surfactant composition is contained, based on the total weight of the composition, in a total amount of more than 1.6 wt. %, or more than 1.7 wt. %, or more than 1.8 wt. %, or more than 1.9 wt. %, or more than 2.0 wt. %, or more than 2.1 wt. %, or more than 2.2 wt. %, or more than 2.3 wt. %, or more than 2.4 wt. %, or more than 2.5 wt. %.

The benzylidene alditol compound of formula (I-1) contained in the viscoelastic, solid surfactant composition is contained, based on the total weight of the composition, preferably in a total amount of more than 1.3 wt. %, more preferably more than 1.5 wt. %, even more preferably of more than 2.0 wt. %. Particularly preferably, the benzylidene alditol compound of formula (I-1) contained in the surfactant composition is contained, based on the total weight of the composition, in a total amount of more than 1.6 wt. %, or more than 1.7 wt. %, or more than 1.8 wt. %, or more than 1.9 wt. %, or more than 2.0 wt. %, or more than 2.1 wt. %, or more than 2.2 wt. %, or more than 2.3 wt. %, or more than 2.4 wt. %, or more than 2.5 wt. %.

In addition to the lower limit of quantity according to the invention (or the preferred lower limit of quantity thereof) of the above-mentioned benzylidene alditol compound, it is favorable to use the benzylidene alditol compound of formula (I) contained in the viscoelastic, solid surfactant composition, based on the total weight of the composition, preferably in a total amount of at most 15 wt. %, in particular of at most 10 wt. %.

In addition to the lower limit of quantity according to the invention (or the preferred lower limit of quantity thereof) of the above-mentioned benzylidene alditol compound, it is favorable to use the benzylidene alditol compound of formula (I-1) contained in the viscoelastic, solid surfactant composition, based on the total weight of the composition, preferably in a total amount of at most 15 wt. %, in particular of at most 10 wt. %.

The viscoelastic, solid surfactant composition according to the invention of the above contains water. It is preferable for water to be contained in the surfactant composition, based on the total weight of the composition, preferably in a total amount of between 0 and 70 wt. %, in particular between 0 and 60 wt. %, more preferably between 0 and 40 wt. %, particularly preferably between 0 and 25 wt. %. The proportion of water in the surfactant composition is very particularly preferably 20 wt. % or less, in turn preferably 15 wt. % or less, in turn more preferably 12 wt. % or less, in particular between 20 and 4 wt. %. The specifications in wt. % refer to the total weight of the composition.

The solubility of the above-mentioned surfactant composition, and the stability thereof, is improved if preferably the surfactant composition additionally contains at least one organic solvent having at least one hydroxyl group, no amino group and having a molecular weight of at most 500 g/mol.

This above-mentioned organic solvent is in turn preferably selected from ($C_2$-$C_8$) alkanols having at least one hydroxyl group (particularly preferably selected from the group ethanol, ethylene glycol, 1,2-propanediol, glycerol, 1,3-propanediol, n-propanol, isopropanol, 1,1,1-trimethylolpropane, 2-methyl-1,3-propanediol, 2-hydroxymethyl-1,3-propanediol, or mixtures thereof), triethylene glycol, butyl diglycol, polyethylene glycols having a weight-average molar mass $M_w$ of at most 500 g/mol, glycerol carbonate, propylene carbonate, 1-methoxy-2-propanol, 3-methoxy-3-methyl-1-butanol, butyl lactate, 2-isobutyl-2-methyl-4-hydroxymethyl-1,3-dioxolane, 2,2-dimethyl-4-hydroxymethyl-1,3-dioxolane, dipropylene glycol, or mixtures thereof.

In this case, it is in turn particularly preferred if the above-mentioned organic solvent is contained in a total amount of from 5 to 40 wt. %, in particular from 10 to 35 wt. %.

Achieving the technical object can be further optimized by at least one polyalkylene oxide compound having a weight-average molar mass $M_w$ of at least 4,000 g/mol, in particular of at least 6,000 g/mol, more preferably of at least 8,000 g/mol, being preferably additionally contained in the composition.

In this case, it has proven to be preferable for said polyalkylene oxide compound to be selected from polyethylene oxide, ethylene oxide-propylene oxide copolymer, and mixtures thereof.

Very particularly preferably, polyethylene oxide having a weight-average molar mass $M_w$ of at least 4,000 g/mol, in particular of at least 6,000 g/mol, more preferably of at least 8,000 g/mol, is used as the polyalkylene oxide compound.

In particular the stability of the above-mentioned surfactant composition is further improved if at least one polymeric polyol, in particular polyvinyl alcohol, is additionally contained. According to the present invention, polymeric polyols have more than 3 hydroxy groups. Suitable polymeric polyols preferably have an average molar mass of from 4,000 to 100,000 g/mol.

The surfactant composition according to the invention preferably contains, based on the total weight thereof, a total amount of from 1 to 30 wt. %, in particular 2 to 20 wt. %, of the polymeric polyol.

Polyvinyl alcohols are thermoplastic materials that are manufactured as white to yellowish powders, usually by hydrolysis of polyvinyl acetate. Polyvinyl alcohol (PVOH) is resistant to almost all water-free organic solvents. Polyvinyl alcohols with an average molar mass of from 30,000 to 60,000 g/mol are preferred.

Polyvinyl alcohols are preferred which comprise a white-yellowish powder or granulate with degrees of polymerization in the range from approximately 100 to 2,500 (molar masses from approximately 4,000 to 100,000 g/mol) and have degrees of hydrolysis of 87-99 mol %, which polyvinyl alcohols therefore still contain residual acetyl groups.

Within the context of the present invention, it is preferred for the surfactant composition to comprise a polyvinyl alcohol of which the degree of hydrolysis is preferably 70 to 100 mol. %, in particular 80 to 90 mol. %, particularly preferably 81 to 89 mol. %, and above all 82 to 88 mol. %. In a preferred embodiment, the water-soluble packaging consists of at least 20 wt. %, particularly preferably at least 40 wt. %, very particularly preferably at least 60 wt. %, and in particular at least 80 wt. %, of a polyvinyl alcohol of which the degree of hydrolysis is 70 to 100 mol. %, preferably 80 to 90 mol. %, particularly preferably 81 to 89 mol. %, and in particular 82 to 88 mol. %.

PVOH powders having the aforementioned properties and suitable for use in the at least one second phase are sold, for example, under the name Mowiol® or Poval® by Kuraray. Particularly suitable are the Poval® grades, in particular grades 3-83, 3-88 and preferably 3-98, and Mowiol® 4-88 from Kuraray.

The water solubility of polyvinyl alcohol can be altered by post-treatment with aldehydes (acetalization) or ketones (ketalization). Particularly preferred and, due to their decidedly good solubility in cold water, particularly advantageous polyvinyl alcohols have been produced which can be acetalized or ketalized with the aldehyde or keto groups of saccharides or polysaccharides or mixtures thereof. It is extremely advantageous to use the reaction products of polyvinyl alcohol and starch. Furthermore, the water solubility can be altered and thus set at desired values in a targeted manner using Ni or Cu salts or by treatment with dichromates, boric acid, or borax.

Surprisingly, it was found that PVOH and/or gelatin is particularly well suited to producing surfactant compositions that meet the specifications outlined above. A surfactant composition according to the invention is therefore particularly preferred which comprises PVOH and at least one organic solvent as described above.

In order to stabilize the viscoelastic, solid composition according to the invention, it is preferable for the composition to additionally contain at least one stabilizer, selected from magnesium oxide, inorganic salt of Mg, Ca, Zn, Na or K (in particular sulfate, carbonate or acetate, more preferably magnesium sulfate, zinc acetate or calcium acetate), acetamide monoethanolamine, hexamethylenetetramine, guanidine, polypropylene glycol ether, salt of amino acids, or mixtures thereof.

It is preferable according to the invention for at least one bittering agent to be contained in the viscoelastic, solid surfactant composition in order to increase product safety.

Preferred bittering agents have a bitter value of at least 1,000, preferably at least 10,000, particularly preferably at least 200,000. In order to determine the bitter value, standardized methods described in European Pharmacopoeia (5th edition, Stuttgart 2005, volume 1, general chapter, monograph groups, 2.8.15 bitterness value, p. 278) are used. An aqueous solution of quinine hydrochloride is used as a comparison, the bitter value of which is determined at 200,000. This means that 1 gram of quinine hydrochloride makes 200 L water bitter. The inter-individual differences in taste in the organoleptic checking of bitterness are compensated for in this method by a correction factor.

Very particularly preferred bittering agents are selected from denatonium benzoate, glycosides, isoprenoids, alkaloids, amino acids, and mixtures thereof, particularly preferably denatonium benzoate.

Glycosides are organic compounds having the general structure R—O—Z, in which an alcohol (R—OH) is connected to a sugar moiety (Z) via a glycosidic bond.

Suitable glycosides are, for example, flavonoids such as quercetin or naringin or iridoid glvcosides such as aucubin and in particular secoiridoid glvcosides such as amarogentin, dihydrofoliamentin, gentiopicroside, gentiopicrin, swertiamarin, sweroside, gentioflavoside, centauroside, methiafolin, harpagoside, centapicrin, salicin, or condurangin.

Isoprenoids are compounds which are formally derived from isoprene. Examples are in particular terpenes and terpenoids.

Suitable isoprenoids include, for example, sesquiterpene lactones such as absinthin, artabsin, cnicin, lactucin, lactucopicrin, or salonitenolide, monoterpene ketone (thujone), such as α-thujone or ß-thujone, tetranortriterpenes (limonoids) such as desoxylimons, desoxylimonic acid, limonin, ichangin, iso-obacunonic acid, nomilin or nomilinic acid, terpenes such as marrubin, premarrubin, carnosol, camosic acid, or quassin.

Alkaloids refer to naturally present, chemically heterogeneous, typically alkaline, nitrogen-containing organic compounds of secondary metabolism which act on the animal or human organism.

Suitable alkaloids are, for example, quinine hydrochloride, quinine hydrogen sulfate, quinine dihydrochloride, quinine sulfate, columbine, and caffeine.

Suitable amino acids include, for example, threonine, methionine, phenylalanine, tryptophan, arginine, histidine, valine, and aspartic acid.

Particularly preferred bitterns are quinine sulfate (bitter value=10,000), naringin (bitter value=10,000), sucrose octaacetate (bitter value=100,000), quinine hydrochloride, denatonium benzoate (bitter value >100,000,000), and mixtures thereof, very particularly preferably denatonium benzoate (e.g. available as Bitrex®).

The viscoelastic, solid surfactant composition preferably contains, based on the total weight thereof, bittering agents in a total amount of at most 1 part by weight bittern to 250 parts by weight viscoelastic, solid surfactant composition (1:250), particularly preferably of at most 1:500, very particularly preferably of at most 1:1,000.

The viscoelastic, solid surfactant composition can be prepared by a liquid composition, containing, based on the total weight thereof, a total amount of more than 1 wt. % of at least one benzylidene alditol compound of formula (I), being brought to a temperature above the sol-gel transition temperature of the liquid composition in the presence of water and 10 to 70 wt. % surfactant and optionally additives (I)

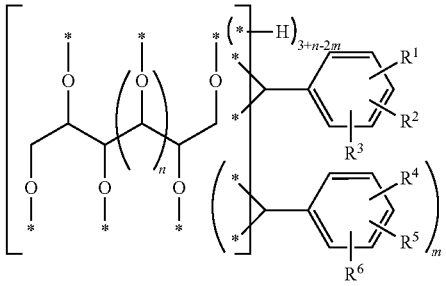

in which *-, n, m, $R^1$, $R^2$, $R^3$, $R^4$, $R^5$ and $R^6$ are as defined in the appended claims, and subsequently the heated liquid composition is introduced into a mold, preferably into a cavity of a cavity mold, and is cooled in said mold to below the sol-gel transition temperature in order to form a viscoelastic, solid shaped body.

It is also possible to first bring a first liquid composition, containing at least one above-mentioned benzylidene alditol compound, to a temperature above the sol-gel transition temperature of the first liquid composition and to mix this first liquid composition with a second liquid composition at a temperature below the sol-gel transition temperature of the first composition, containing water and at least one surfactant, in order to obtain a liquid composition, containing more than 1 wt. % of at least one said benzylidene alditol compound, 10 to 70 wt. % of at least one surfactant and water, and to introduce this composition into a mold.

The liquid composition is brought to below the sol-gel transition temperature of the liquid composition in the mold in order to cure the liquid composition. In this case, it is preferable according to the invention for the liquid composition to be cooled to no lower than 20° C., in particular to no lower than 25° C., particularly preferably to no lower than 30° C., in order to form the above-mentioned shaped body.

A corresponding shaped body can also be produced by extruding the viscoelastic, solid surfactant composition, with subsequent rounding if necessary. This can produce a free-flowing product or pellets.

It is preferable according to the invention for the viscoelastic, solid surfactant composition of the first subject matter of the invention to be present as a shaped body.

A shaped body is a single body that stabilizes itself in the shape imparted to it. This dimensionally stable body is formed from a molding compound (e.g. a composition) in such a way that this molding compound is deliberately brought into a predetermined shape, for example by pouring a liquid composition into a casting mold and then curing the liquid composition, for example as part of a sol-gel process. In this case, all conceivable shapes are possible, such as a ball, cube, cuboid, round disk, trough, shell, prism, octahedron, tetrahedron, egg shape, dog, cat, mouse, horse, torso, bust, pillow, automobile, oval disk with embossed trademark, and many others.

It is preferable according to the invention for the shaped body of the viscoelastic, solid surfactant composition of the first subject matter of the invention to have a weight of at least 1 g, preferably of at least 5 g, particularly preferably at least 10 g.

It is preferable according to the invention for the shaped body according to the invention of the viscoelastic, solid surfactant composition of the first subject matter of the invention to have a weight of at most 80 g, in particular of at most 70 g, particularly preferably of at most 50 g, very particularly preferably of at most 40 g, most preferably of at most 30 g. In this connection, the above-mentioned minimum weights of the shaped body are particularly preferred.

Very particularly preferably, the shaped body of the viscoelastic, solid surfactant composition of the first subject matter of the invention has a weight of from 10 to 80 g, in particular from 10 to 70 g, more preferably from 10 to 50 g, most preferably from 10 to 30 g, for example 15 g or 25 g. In this case, it is in turn preferable for said shaped body to contain surfactant in the total amounts characterized as preferable (vide supra).

The shaped bodies of the above-mentioned viscoelastic, solid composition can also contain at least two different viscoelastic, solid surfactant compositions of the first subject matter of the invention in order to form at least two phases, preferably at least two differently colored phases. For example, a cavity shaped-body as a first phase can be produced from a first viscoelastic, solid surfactant composition of the first subject matter of the invention, into the cavity of which cavity shaped-body a second viscoelastic, solid surfactant composition of the first subject matter of the invention is introduced as a second phase. The shaped body can also be formed of different viscoelastic, solid compositions which are arranged as phases arranged in layers one above the other.

A corresponding cavity shaped-body of the surfactant composition according to the invention can preferably be designed as a container having at least one cavity, e.g. in the form of a trough or shell, such that the volume of the walls is smaller than the total volume of all the cavities. The walls of a cavity shaped-body of this embodiment preferably have an average thickness of at most 5 mm, in particular of at most 2 mm, more preferably of at most 1 mm. The total volume of the cavities of this embodiment preferably has a volume of at least 5 mL, in particular of at least 10 mL, more preferably of at least 15 mL.

Within the meaning of the present invention, a phase is a spatial region in which physical parameters and the chemical composition are homogeneous. One phase differs from another phase in terms of its different features, such as ingredients, external appearance, etc. Preferably, different phases can be visually differentiated from one another. A first phase can thus be clearly distinguished from the second phase by a consumer. If the agent of the portion according to the invention has more than one first phase, then they can preferably also each be distinguished from one another with the naked eye because of their different coloration, for example. The same applies when two or more second phases are present. In this case as well, a visual differentiation of the phases, for example on the basis of a difference in coloration or transparency, is preferably possible. Within the meaning of the present invention, phases are thus self-contained regions that can be differentiated visually from one another by a consumer with the naked eye. The individual phases can have different properties during use.

It is preferable according to the invention for at least one bittering agent to have been homogeneously incorporated into the shaped body in order to increase the product safety and/or the surface of the shaped body to have been provided with at least one bittering agent by means of coating. It is preferable to homogeneously incorporate the at least one bittering agent into the shaped body as an ingredient of the viscoelastic, solid surfactant composition. Preferred bittering agents and amounts are those mentioned above (vide supra).

In order to prevent individual shaped bodies in a packaging from sticking together, it may be preferable to powder the shaped bodies using a powdery solid. Preferred agents for powdering are selected from talcum, sodium sulfate, starch, pectin, amylopectin, dextrin, lactic acid, lactose, or mixtures thereof.

The surfaces of the shaped bodies can be printed for further esthetic enrichment and/or to apply instructions or manufacturer names. In this case, the use of ink-jet printing is preferred.

All the above-mentioned preferred embodiments of the surfactant composition according to the invention are also preferred for providing a shaped body according to the invention.

A second subject matter of the invention is a portion, containing at least one viscoelastic, solid surfactant composition of the first subject matter of the invention. In this case, it is preferable according to the invention for the portion to contain the viscoelastic, solid surfactant composition according to the invention of the first subject matter of the invention as a shaped body. In this case, it is in turn preferable for the portion to contain, based on the total weight thereof, the shaped body in an amount of at least 5 wt. %, in particular at least 15 wt. %, in particular at least 50 wt. %, in particular at least 80 wt. %, in particular at least 90 wt. %, particularly preferably at least 95 wt. %.

A portion is an independent dosing unit which provides an amount of textile treatment agent for a use, preferably for a use in a washing machine. The viscoelastic, solid surfactant composition according to the invention can either be the only textile treatment agent of the portion, or be manufactured in the portion together with at least one additional composition that is different from the viscoelastic, solid surfactant composition of the first subject matter of the invention and overall form the textile treatment agent of the portion.

It is preferable according to the invention for the portion according to the invention to contain at least one shaped body of the viscoelastic, solid surfactant composition of the first subject matter of the invention, which shaped body has a weight of at least 1 g, preferably of at least 5 g, particularly preferably at least 10 g.

It is preferable according to the invention for the portion according to the invention to contain at least one shaped body of the viscoelastic, solid surfactant composition of the first subject matter of the invention, which shaped body has a weight of at most 80 g, in particular of at most 70 g, particularly preferably of at most 50 g, very particularly preferably of at most 40 g. In this connection, the above-mentioned minimum weights of the shaped body are particularly preferred.

Very particularly preferably, the portion according to the invention comprises a shaped body of the viscoelastic, solid surfactant composition of the first subject matter of the invention having a weight of from 1 to 80 g, in particular from 1 to 70 g, more preferably from 1 to 50 g, even more preferably from 1 to 30 g, in particular from 10 to 80 g, in particular from 10 to 70 g, more preferably from 10 to 50 g, most preferably from 10 to 30 g, for example 15 g or 25 g. In this case, it is in turn preferable for said shaped body to contain surfactant in the total amounts characterized as preferable (vide supra).

Very particularly preferred portions are those of embodiments (P1) to (P4):

(P1): a portion, containing, based on the weight of the portion, at least 80 wt. %, preferably at least 90 wt. %, of a shaped body of at least one viscoelastic, solid surfactant composition of the first subject matter of the invention, the shaped body having a weight of at least 1 g, preferably of at least 5 g, particularly preferably at least 10 g, very particularly preferably from 10 g to 30 g.

(P2): a portion, containing, based on the weight of the portion, at least 80 wt. %, preferably at least 90 wt. %, of a shaped body of at least one viscoelastic, solid surfactant composition of the first subject matter of the invention, the shaped body being transparent and having a weight of at least 1 g, preferably of at least 5 g, particularly preferably at least 10 g, very particularly preferably from 10 g to 30 g.

(P3): a portion, containing, based on the weight of the portion, at least 80 wt. %, preferably at least 90 wt. %, of a shaped body of at least one viscoelastic, solid surfactant composition of the first subject matter of the invention, containing, based on the total weight of the surfactant composition, (i) 10 to 60 wt. % of at least one anionic surfactant, preferably at least one $C_{9-13}$ alkylbenzene sulfonate being contained as an anionic surfactant, and 2 to 35 wt. % of at least one non-ionic surfactant, preferably at least one alkoxylated alcohol having 8 to 18 carbon atoms and on average 4 to 12 mol ethylene oxide (EO) per mol of alcohol being contained as a non-ionic surfactant, with the proviso that surfactant is contained in a total amount of from 10 to 70 wt. %, in particular from 15 to 70 wt. %, and (ii) a total amount of more than 1 wt. % of at least one benzylidene alditol compound of formula (I)

(I)

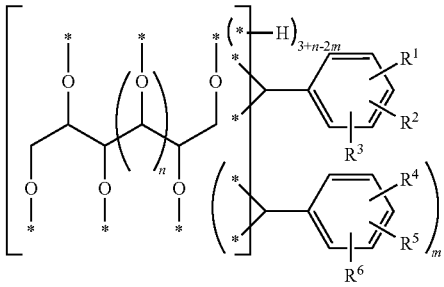

in which

*- represents a covalent single bond between an oxygen atom of the alditol backbone and the provided functional group, n represents 0 or 1, preferably 1, m represents 0 or 1, preferably 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxy group, a —C(=O)—NH—$NH_2$ group, a —NH—C(=O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxy group, a —C(=O)—NH—$NH_2$ group, a —NH—C(=O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, and (iii) between 0 and 40 wt. %, particularly preferably between 0 and 25 wt. %, water, the shaped body having a weight of at least 1 g, preferably of at least 5 g, particularly preferably at least 10 g, very particularly preferably from 10 g to 30 g.

(P4): a portion, containing, based on the weight of the portion, at least 80 wt. %, preferably at least 90 wt. %, of a shaped body of at least one viscoelastic, solid surfactant composition of the first subject matter of the invention, containing, based on the total weight of the surfactant composition, (i) 10 to 60 wt. % of at least one anionic surfactant, preferably at least one $C_{9-13}$ alkylbenzene sulfonate being contained as an anionic surfactant, and 2 to 35 wt. % of at least one non-ionic surfactant, preferably at least one alkoxylated alcohol having 8 to 18 carbon atoms and on average 4 to 12 mol ethylene oxide (EO) per mol of alcohol being contained as a non-ionic surfactant, with the proviso that surfactant is contained in a total amount of from 10 to 70 wt. %, and (ii) a total amount of more than 1 wt. % of at least one benzylidene alditol compound of formula (I)

(I)

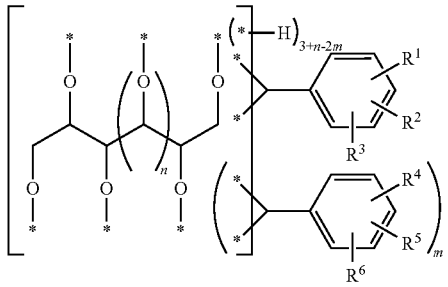

in which

*- represents a covalent single bond between an oxygen atom of the alditol backbone and the provided functional group, n represents 0 or 1, preferably 1, m represents 0 or 1, preferably 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxy group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxy group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, and (iii) between 0 and 40 wt. %, particularly preferably between 0 and 25 wt. %, water, the shaped body being transparent and having a weight of at least 1 g, preferably of at least 5 g, particularly preferably at least 10 g, very particularly preferably from 10 g to 30 g.

All the above-mentioned preferred embodiments of the surfactant composition according to the invention and of the shaped body according to the invention are also preferred for providing a portion according to the invention.

In order to prevent direct skin contact of the user with the viscoelastic, solid surfactant composition when the portion is being used, the shaped body is preferably wrapped with water-soluble material. A wrapping of this kind has proven to be favorable with regard to the storage stability of the shaped bodies according to the invention used in the portions.

Within the context of a preferred embodiment, the surface of the above-mentioned shaped body of the portion is coated with at least one water-soluble material, preferably with at least one water-soluble polymer. Coating can be carried out for example by spraying a solution or by immersion in a melt, the melting temperature in the latter method being preferably below the sol-gel temperature. It can be preferable in turn to powder the shaped bodies coated with at least one water-soluble material with at least one powdery solid. Preferred agents for powdering are those mentioned above (vide supra).

According to another embodiment as a pouch, the portion according to the invention can contain at least one chamber having walls made of water-soluble material, into which chamber the at least one shaped body of a viscoelastic, solid surfactant composition of the first subject matter of the invention is introduced. Adding together all the chambers of the portion, the compositions produced overall therein produce the product to be dosed of the portion (here a textile treatment agent). Corresponding portions of this embodiment are known to a person skilled in the art as pouch products.

A chamber is a space delimited by walls (e.g. by a film), which space can also exist without the product to be dosed (optionally by changing its shape). A layer of a surface coating is not explicitly covered by the definition of a wall. In a pouch, the water-soluble material forms the walls of the chamber and thereby covers the compositions of the textile treatment agent.

A material is water-soluble if 0.1 g of the material dissolves in 800 mL water within 600 seconds when stirred (stirring speed magnet stirrer 300 rpm, stirring rod: 6.8 cm long, diameter 10 mm, beaker glass 1,000 mL, low shape from Schott, Mainz) at 20° C., such that no solid particles at all of the material can be seen with the naked eye.

The water solubility of the material, in the form of a film, used for wrapping for the production of pouches can be determined using a square film of said material (film: 22×22 mm with a thickness of 76 μm) fixed in a square frame (inside edge length: 20 mm) according to the following measurement protocol. Said framed film is submerged into 800 mL distilled water, temperature-controlled to 20° C., in a 1 liter beaker with a circular base (Schott, Mainz, beaker glass 1,000 mL, low shape), so that the surface of the tensioned film is arranged at a right angle to the base of the beaker glass, the upper edge of the frame is 1 cm below the water surface, and the lower edge of the frame is oriented in parallel with the base of the beaker glass such that the lower edge of the frame extends along the radius of the base of the beaker glass and the center of the lower edge of the frame is arranged above the center of the radius of the beaker glass bottom. The material should dissolve within 600 seconds when stirred (stirring speed magnet stirrer 300 rpm, stirring rod: 6.8 cm long, diameter 10 mm), such that no solid film particles at all can be seen with the naked eye.

The water-soluble material generally used for wrapping the shaped body preferably contains at least one water-soluble polymer. It is preferable for the water-soluble material to contain polyvinyl alcohol or a polyvinyl alcohol copolymer.

Suitable water-soluble material and water-soluble films as the water-soluble material are preferably based on a polyvinyl alcohol or a polyvinyl alcohol copolymer of which the molecular weight is in the range of from 10,000 to 1,000,000 $\mu mol^{-1}$, preferably 20,000 to 500,000 $\mu mol^{-1}$, particularly preferably 30,000 to 100,000 $\mu mol^{-1}$ and in particular 40,000 to 80,000 $\mu mol^{-1}$.

Polyvinyl alcohol is usually produced by hydrolysis of polyvinyl acetate, since the direct synthesis route is not possible. The same applies to polyvinyl alcohol copolymers, which are produced accordingly from polyvinyl acetate copolymers. It is preferable for the water-soluble material to include at least one polyvinyl alcohol of which the degree of hydrolysis is from 70 to 100 mol. %, preferably from 80 to 90 mol. %, particularly preferably from 81 to 89 mol. %, and in particular from 82 to 88 mol. %.

Polymers selected from the group comprising acrylic acid-containing polymers, polyacrylamides, oxazoline polymers, polystyrene sulfonates, polyurethanes, polyesters, polyethers, polylactic acid, and/or mixtures of the above polymers may additionally be added to the water-soluble material.

Preferred polyvinyl alcohol copolymers include, in addition to vinyl alcohol, dicarboxylic acids as further monomers. Suitable dicarboxylic acids are itaconic acid, malonic acid, succinic acid and mixtures thereof, with itaconic acid being preferred.

Polyvinyl alcohol copolymers which include, in addition to vinyl alcohol, an ethylenically unsaturated carboxylic acid, or the salt or ester thereof, are also preferred. Polyvinyl alcohol copolymers of this kind particularly preferably contain, in addition to vinyl alcohol, acrylic acid, methacrylic acid, acrylic acid ester, methacrylic acid ester, or mixtures thereof.

The water-soluble material of the film material used for providing the pouch walls has a preferred thickness in a range of from 65 to 180 μm, in particular from 70 to 150 μm, more preferably 75 to 120 μm.

A bittering agent is preferably incorporated into the above-mentioned water-soluble material of the coating of the shaped body of the portion or of the walls of the pouches of the portion, in order to increase product safety. Corresponding embodiments of the water-soluble material with a bittering agent are described in EP-B1-2 885 220 and EP-B1-2 885 221. A preferred bittering agent is selected from the above-mentioned bittering agents (vide supra), in particular denatonium benzoate.

Portions according to the invention in the form of pouches can be produced either by methods of vertical form fill sealing (VFFS) or thermoforming methods. Particularly preferably, walls of at least one chamber are produced by sealing at least one film made of water-soluble material, in particular by sealing within the context of a form fill sealing method. The thermoforming method generally includes forming a first layer from a water-soluble film material in order to produce at least one bulge for receiving at least one composition in each case, pouring the composition into the relevant bulge, covering the bulge filled with the composition with a second layer made of a water-soluble film material, and sealing the first and second layers to one another at least around the bulge.

Another subject matter of the invention is a substrate treatment method comprising the method steps of (a) providing a surfactant-containing liquor by mixing 0.5 L to 40.0 L water with a viscoelastic, solid surfactant composition of the first subject matter of the invention, and (b) bringing at least one textile into contact with the surfactant-containing liquor produced according to (a).

The following points constitute particular embodiments of the invention:

1. A viscoelastic, solid surfactant composition, containing, based on the total weight thereof, (i) a total amount of from 10 to 70 wt. % of at least one surfactant and (ii) a total amount of more than 1 wt. % of at least one benzylidene alditol compound of formula (I)

(I)

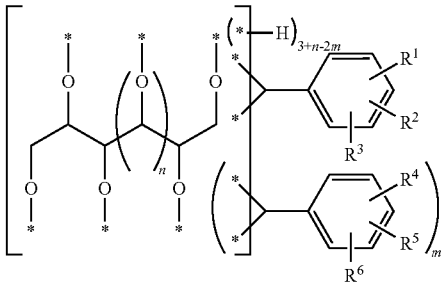

in which represents a covalent single bond between an oxygen atom of the alditol backbone and the provided functional group, n represents 0 or 1, preferably 1, m represents 0 or 1, preferably 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxy group, a —C(=O)—NH—$NH_2$ group, a —NH—C(=O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxy group, a —C(=O)—NH—$NH_2$ group, a —NH—C(=O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, and (iii) water.

2. The composition according to point 1, characterized in that the surfactant composition has a storage modulus of between $10^3$ Pa and $10^8$ Pa, preferably between $10^4$ Pa and $10^8$ Pa, and a loss modulus (in each case at 20° C., with a deformation of 0.1% and a frequency of 1 Hz), and the storage modulus in the frequency range between $10^{-2}$ Hz and 10 Hz is at least twice as great as the loss modulus, preferably five times greater than the loss modulus, particularly preferably ten times greater than the loss modulus.

3. The composition according to point 1 or 2, characterized in that it contains at least one anionic surfactant.

4. The composition according to point 3, characterized in that at least one anionic surfactant selected from the group consisting of $C_{8-18}$ alkylbenzene sulfonates, olefin sulfonates, $C_{12-18}$ alkane sulfonates, ester sulfonates, alk(en)yl sulfates, fatty alcohol ether sulfates, and mixtures thereof, is contained.

5. The composition according to one of points 1 to 4, characterized in that at least one compound of formula (T1) is contained as the surfactant (T1)

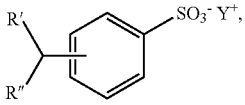

in which

R' and R" are, independently of one another, H or alkyl, and together contain 9 to 19, preferably 9 to 15, and in particular 9 to 13, C atoms, and $Y^+$ indicates a monovalent cation or the nth part of an n-valent cation (in particular $Na^+$).

6. The composition according to one of points 1 to 5, characterized in that it contains at least one non-ionic surfactant.

7. The composition according to one of points 1 to 6, characterized in that it contains at least one non-ionic surfactant of formula (T2) as the surfactant $$R^2—O—(XO)_m—H, \quad (T2)$$

in which $R^2$ represents a linear or branched $C_8$-$C_{18}$ alkyl functional group, an aryl functional group or alkylaryl functional group, XO represents, independently of one another, an ethylene oxide (EO) or propylene oxide (PO) group, m represents an integer from 1 to 50.

8. The composition according to one of points 1 to 7, characterized in that it contains, based on its total weight, a total surfactant content of from 10 to 60 wt. %, in particular from 15 to 65 wt. %, preferably from 20 to 60 wt. %.

9. The composition according to one of points 1 to 8, characterized in that the alditol backbone according to formula (I) is derived from D-glucitol, D-mannitol, D-arabinitol, D-ribitol, D-xylitol, L-glucitol, L-mannitol, L-arabinitol, L-ribitol, or L-xylitol.

10. The composition according to one of points 1 to 9, characterized in that $R^1$, $R^2$, $R^3$, $R^4$, $R^5$ and $R^6$ mean, independently of one another, a hydrogen atom, methyl, ethyl, chlorine, fluorine, or methoxy, preferably a hydrogen atom.

11. The composition according to one of points 1 to 10, characterized in that it contains, as the benzylidene alditol compound of formula (I), at least one compound of formula (I-1)

(I-1)

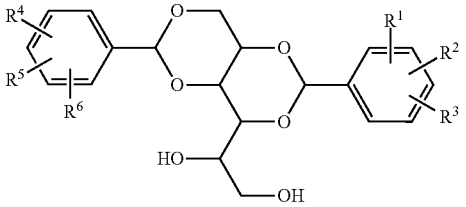

in which $R^1$, $R^2$, $R^3$, $R^4$, $R^5$ and $R^6$ are as defined in point 1.

12. The composition according to one of points 1 to 11, characterized in that the benzylidene alditol compound of formula (I) is selected from 1,3:2,4-di-O-benzylidene-D-sorbitol; 1,3:2,4-di-O-(p-methylbenzylidene)-D-sorbitol; 1,3:2,4-di-O-(p-chlorobenzylidene)-D-sorbitol; 1,3:2,4-di-O-(2,4-dimethylbenzylidene)-D-sorbitol; 1,3:2,4-di-O-(p-ethylbenzylidene)-D-sorbitol; 1,3:2,4-di-O-(3,4-dimethylbenzyliden)-D-sorbitol, or mixtures thereof.

13. The composition according to one of points 1 to 12, characterized in that the benzylidene alditol compound of formula (I) is contained in a total amount of more than 1.5 wt. %, in particular of more than 2.0 wt. %.

14. The composition according to one of points 1 to 13, characterized in that water is contained in a total amount of between 0 and 45 wt. %, in particular between 0 and 25 wt. %.

15. The composition according to one of the preceding points, characterized in that it additionally contains at least one organic solvent having at least one hydroxyl group, no amino group and having a molecular weight of at most 500 g/mol (preferably selected from ($C_2$-$C_8$) alkanols having at least one hydroxyl group (particularly preferably ethanol, ethylene glycol, 1,2-propanediol, glycerol, 1,3-propanediol, n-propanol, isopropanol, 1,1,1-trimethylolpropane, 2-methyl-1,3-propanediol, 2-hydroxymethyl-1,3-propanediol), triethylene glycol, butyl diglycol, polyethylene glycols having a weight-average molar mass $M_w$ of at most 500 g/mol, glycerol carbonate, propylene carbonate, 1-methoxy-2-propanol, 3-methoxy-3-methyl-1-butanol, butyl lactate, 2-isobutyl-2-methyl-4-hydroxymethyl-1,3-dioxolane, 2,2-dimethyl-4-hydroxymethyl-1,3-dioxolane, dipropylene glycol, or mixtures thereof).

16. The composition according to point 15, characterized in that the above-mentioned organic solvent is contained in a total amount of from 5 to 40 wt. %, in particular from 10 to 35 wt. %.

17. The composition according to one of the preceding points, characterized in that at least one polyalkylene oxide compound having a weight-average molar mass $M_w$ of at least 4,000 g/mol is additionally contained.

18. The composition according to point 17, characterized in that the above-mentioned polyalkylene oxide compound is selected from polyethylene oxide, ethylene oxide-propylene oxide copolymer, and mixtures thereof.

19. The composition according to one of the preceding points, characterized in that at least one polymeric polyol, in particular polyvinyl alcohol, is additionally contained.

20. The composition according to one of the preceding points, characterized in that the storage modulus is in a range of from $10^5$ Pa to $10^7$ Pa.

21. The composition according to one of the preceding points, characterized in that additionally at least one stabilizer is contained, selected from magnesium sulfate, zinc acetate, calcium acetate, magnesium oxide, inorganic salt (in particular sulfate, acetate, or carbonate) of Mg, Ca, Zn, Na, or K, acetamide monoethanolamine, hexamethylenetetramine, guanidine, polypropylene glycol ether, salt of amino acids, or mixtures thereof.

22. The composition according to one of the preceding points, characterized in that it is present as a shaped body, in particular having a weight of at least 1 g, preferably at least 5 g, particularly preferably from 10 g to 30 g.

23. The composition according to one of the preceding points, characterized in that it has a yield point in the range of from 2.5 to 100 Pa, more preferably from 3 to 80 Pa (measured using a rotational rheometer, cone-plate measuring system of a 40 mm diameter and 2° opening angle at a temperature of 20° C.).

24. The composition according to one of the preceding points, characterized in that the composition is transparent.
25. A portion, containing at least one surfactant composition according to one of points 1 to 24.
26. The portion according to point 25, characterized in that it additionally contains another composition.
27. The portion according to one of points 25 or 26, characterized in that it is designed as a shaped body of at least one surfactant composition of points 1 to 23, the shaped body preferably having a weight of at least 1 g, particularly preferably of at least 5 g, very particularly preferably of from 10 g to 30 g.
28. The portion according to point 25 or 26, characterized in that it comprises at least one chamber having a wall made of water-soluble material, the portion containing at least one viscoelastic, solid shaped body according to point 23.
29. A substrate treatment method comprising the method steps of
    (a) providing an aqueous liquor by mixing 0.5 L to 40.0 L water with 0.5 to 100 g of a composition according to one of points 1 to 24, and
    (b) bringing at least one textile into contact with the aqueous liquor produced according to (a).
30. A method for preparing a solid surfactant composition according to one of points 1 to 24, characterized in that a liquid composition, containing, based on the total weight thereof, a total amount of more than 1 wt. % of at least one benzylidene alditol compound of formula (I)

(I)

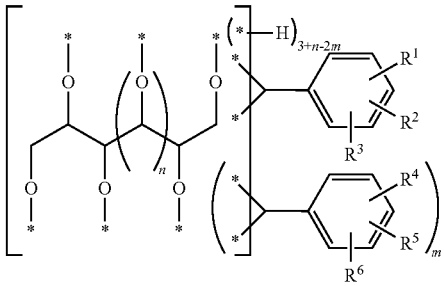

in which *-, n, m, $R^1$, $R^2$, $R^3$, $R^4$, $R^5$ and $R^6$ are as defined in point 1, is first brought to a temperature above the sol-gel transition temperature of the liquid composition in the presence of water and 10 to 70 wt. % surfactant, and optionally additives, and subsequently the heated liquid composition is introduced into a mold, preferably into a cavity of a cavity mold, and is cooled in said mold to below the sol-gel transition temperature in order to form a viscoelastic, solid shaped body.

Examples

In order to provide the shaped bodies, the clear, liquid washing agents F1 to F6 were produced according to Table 1.

TABLE 1

| | Liquid washing agent | | | | | |
|---|---|---|---|---|---|---|
| | F1 [wt. %] | F2 [wt. %] | F3 [wt. %] | F4 [wt. %] | F5 [wt. %] | F6 [wt. %] |
| $C_{11-13}$ alkylbenzene sulfonic acid | 23.0 | 26.0 | 23.0 | 9.0 | 3.0 | 6.0 |
| ($C_{12-14}$) fatty alcohol ether sulfate with 2 units of ethylene oxide | — | — | — | 9.0 | 4.6 | 6.0 |
| $C_{13-15}$ alkyl alcohol branched at the 2-position, ethoxylated with 8 mol ethylene oxide | 24.0 | 27.0 | 24.0 | 6.0 | — | 3.0 |
| Fatty alcohol ether sulfate ethoxylated with 7 mol ethylene oxide | — | — | — | — | 3.7 | — |
| Glycerin | 9.0 | 9.0 | 9.0 | — | — | — |
| 2-aminoethanol | 6.8 | 6.8 | 6.8 | — | — | — |
| Sodium hydroxide | — | — | — | 4.0 | 0.6 | 2.0 |
| Ethoxylated polyethyleneimine | 5.0 | 5.0 | 5.0 | — | — | — |
| $C_{12-18}$ fatty acid | 7.5 | 7.5 | 7.5 | 1.0 | 1.3 | 3.0 |
| Diethylenetriamine-N,N,N',N',N''-penta(methylene phosphonic acid), heptasodium salt (sodium DTPMP) | 0.6 | 0.6 | 0.6 | 3.0 | 0.2 | 1.0 |
| Citric acid | — | — | — | up to pH 8.5 | up to pH 8.5 | 2.0 |
| Boric acid | — | — | — | 1.0 | 0.5 | 1.0 |
| 1,2-propylene glycol | 4.5 | 4.5 | 4.5 | 2.0 | 0.5 | 1.0 |
| Ethanol | 4.0 | 4.0 | 4.0 | 1.0 | 0.2 | 1.0 |
| Sodium bisulfite | 0.1 | 0.1 | 0.1 | — | — | — |
| Denatonium benzoate | 0.001 | 0.001 | 0.001 | 0.001 | 0.001 | 0.001 |

TABLE 1-continued

| | Liquid washing agent | | | | | |
|---|---|---|---|---|---|---|
| | F1 [wt. %] | F2 [wt. %] | F3 [wt. %] | F4 [wt. %] | F5 [wt. %] | F6 [wt. %] |
| Soil release polymer made of ethylene terephthalate and polyethylene oxide terephthalate | 1.0 | 1.0 | 0.6 | 0.5 | — | 0.5 |
| Sokalan HP 56 | — | — | 0.15 | 0.2 | — | — |
| Perfume, dye, protease, amylase, lipase, cellulase, optical brightener | 1.7 | 1.7 (without dye) | 1.5 (without optical brightener) | 2.6 | 1.0 | 2.6 |
| Water | up to 100 | up to 100 | up to 100 | up to 100 | up to 100 | up to 100 |

In order to produce a shaped body from one of the liquid washing agents in Table 1, a premix was first produced as a solution of 8 g 1,3:2,4-di-O-benzyliden-D-sorbitol and 92 g of the selected liquid washing agent in Table 1 by being heated. 15 g of the hot and clear premix was incorporated in 85 g of the room-temperature liquid washing agent in Table 1 by being stirred vigorously. 19 g of the resulting solution was quickly introduced into a cubical cavity mold. The temperature of the solution in the cavity was gradually lowered to room temperature. After setting, the shaped body was removed from the cavity. The shaped bodies prepared in this way each had a storage modulus in the order of magnitude of $10^6$ Pa, which storage modulus was at least ten times greater than the loss modulus.

All of the shaped bodies were transparent. The shaped body F2 was transparent and had a transmission of 61.3%.

What is claimed is:

1. A viscoelastic, solid surfactant composition for treating textiles, comprising, based on the total weight thereof, (i) a total amount of from 10 to 70 wt. % of at least one surfactant and (ii) a total amount of more than 2 wt. % of at least one benzylidene alditol compound of formula (I)

(I)

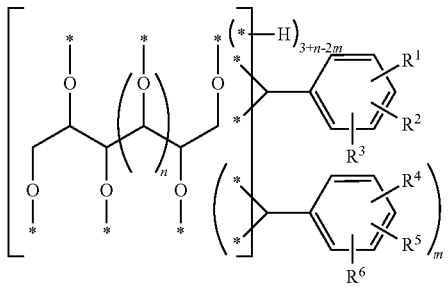

in which

*- represents a covalent single bond between an oxygen atom of the alditol backbone and the provided functional group, n represents 0 or 1, m represents 0 or 1, $R^1$, $R^2$ and $R^3$ represent, independently of one another, a hydrogen atom, a halogen atom, a $C_1$-$C_4$ alkyl group, a cyano group, a nitro group, an amino group, a carboxyl group, a hydroxy group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, $R^4$, $R^5$ and $R^6$ represent, independently of one another, a hydrogen atom, a halogen atom, a $C_1$-$C_4$ alkyl group, a cyano group, a nitro group, an amino group, a carboxyl group, a hydroxy group, a —C(═O)—NH—$NH_2$ group, a —NH—C(═O)—($C_2$-$C_4$-alkyl) group, a $C_1$-$C_4$ alkoxy group, a $C_1$-$C_4$ alkoxy $C_2$-$C_4$ alkyl group, with two of the functional groups forming, together with the remainder of the molecule, a 5-membered or 6-membered ring, and (iii) water;

wherein the composition is in the form of a shaped body with a storage modulus of between $10^3$ Pa and $10^8$ Pa and a loss modulus (at 20° C., with a deformation of 0.1% and a frequency of 1 Hz), and the storage modulus in the frequency range between $10^{-2}$ Hz and 10 Hz is at least twice as great as the loss modulus.

2. The composition according to claim 1 wherein it comprises at least one anionic surfactant.

3. The composition according to claim 2, wherein at least one anionic surfactant selected from the group consisting of $C_{8-18}$ alkylbenzene sulfonates, olefin sulfonates, $C_{12-18}$ alkane sulfonates, ester sulfonates, alkyl sulfates, alkenyl sulfates, fatty alcohol ether sulfates, and mixtures thereof.

4. The composition according to claim 1, wherein it comprises at least one non-ionic surfactant.

5. The composition according to claim 1, wherein it comprises at least one non-ionic surfactant of formula (T2) as the surfactant $$R^2—O—(XO)_m—H, \quad (T2)$$

in which $R^2$ represents a linear or branched $C_8$-$C_{18}$ alkyl functional group, an aryl functional group or alkylaryl functional group, XO represents, independently of one another, an ethylene oxide (EO) or propylene oxide (PO) group, m represents an integer from 1 to 50.

6. The composition according to claim 1, wherein the alditol backbone according to formula (I) is derived from D-glucitol, D-mannitol, D-arabinitol, D-ribitol, D-xylitol, L-glucitol, L-mannitol, L-arabinitol, L-ribitol, or L-xylitol.

7. The composition according to claim 1, wherein $R^1$, $R^2$, $R^3$, $R^4$, $R^5$ and $R^6$ mean, independently of one another, a hydrogen atom, methyl, ethyl, chlorine, fluorine, or methoxy.

8. The composition according to claim 1, wherein it comprises, as a benzylidene alditol compound of formula (I), at least one compound of formula (I-1)

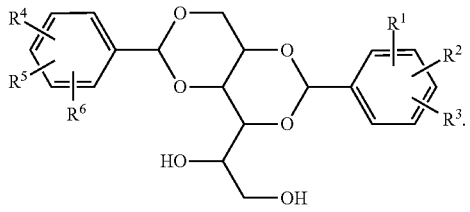

(I-1)

9. The composition according to claim 1, wherein the benzylidene alditol compound of formula (I) is selected from 1,3:2,4-di-O-benzylidene-D-sorbitol; 1,3:2,4-di-O-(p-methylbenzylidene)-D-sorbitol; 1,3:2,4-di-O-(p-chlorobenzylidene)-D-sorbitol; 1,3:2,4-di-O-(2,4-dimethylbenzylidene)-D-sorbitol; 1,3:2,4-di-O-(p-ethylbenzylidene)-D-sorbitol; 1,3:2,4-di-O-(3,4-dimethylbenzyliden)-D-sorbitol, or mixtures thereof.

10. The composition according to claim 1, wherein the amount of water is between 4 and 20 wt. %.

11. The composition according to claim 1, wherein it additionally comprises at least one organic solvent having at least one hydroxyl group, no amino group and having a molecular weight of at most 500 g/mol selected from ($C_2$-$C_8$) alkanols having at least one hydroxyl group, triethylene glycol, butyl diglycol, polyethylene glycols having a weight-average molar mass $M_w$ of at most 500 g/mol, glycerol carbonate, propylene carbonate, 1-methoxy-2-propanol, 3-methoxy-3-methyl-1-butanol, butyl lactate, 2-isobutyl-2-methyl-4-hydroxymethyl-1,3-dioxolane, 2,2-dimethyl-4-hydroxymethyl-1,3-dioxolane, dipropylene glycol, or mixtures thereof.

12. The composition according to claim 11, wherein the amount of organic solvent is from 5 to 40 wt. %.

13. The composition according to claim 1, wherein the storage modulus is in a range from $10^5$ Pa to $10^7$ Pa.

14. A method for treating textiles, comprising the method steps of (a) providing an aqueous liquor by mixing 0.5 L to 40.0 L water with 0.5 to 100 g of a composition according to claim 1, and (b) bringing at least one textile into contact with the aqueous liquor produced according to (a).

* * * * *